US008647219B2

(12) United States Patent
Kim et al.

(10) Patent No.: US 8,647,219 B2
(45) Date of Patent: Feb. 11, 2014

(54) GOLF BALL

(75) Inventors: Hyoungchol Kim, Kobe (JP); Takahiro Sajima, Kobe (JP); Kaname Yamada, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 13/404,404

(22) Filed: Feb. 24, 2012

(65) Prior Publication Data

US 2012/0158372 A1 Jun. 21, 2012

Related U.S. Application Data

(62) Division of application No. 12/345,739, filed on Dec. 30, 2008, now Pat. No. 8,202,177.

(30) Foreign Application Priority Data

Jan. 25, 2008 (JP) ..... 2008-014839

(51) Int. Cl.
*A63B 37/00* (2006.01)

(52) U.S. Cl.
USPC ..... 473/351

(58) Field of Classification Search
USPC ..... 473/351, 409, 383–385
See application file for complete search history.

(56) References Cited

U.S. PATENT DOCUMENTS

| | | | |
|---|---|---|---|
| 4,729,861 | A | 3/1988 | Lynch et al. |
| 4,744,564 | A | 5/1988 | Yamada |
| 4,936,587 | A | 6/1990 | Lynch et al. |
| 4,968,038 | A | 11/1990 | Yamada |
| 5,080,367 | A | 1/1992 | Lynch et al. |
| 5,798,833 | A | 8/1998 | Onuki et al. |

FOREIGN PATENT DOCUMENTS

| | | | |
|---|---|---|---|
| JP | 50-8630 | A | 1/1975 |
| JP | 61-284264 | A | 12/1986 |
| JP | 01-175871 | A | 7/1989 |
| JP | 09-068539 | A | 3/1997 |

*Primary Examiner* — Raeann Gorden
(74) *Attorney, Agent, or Firm* — Birch, Stewart, Kolasch & Birch, LLP

(57) ABSTRACT

Based on a surface shape appearing at a predetermined point moment by moment during rotation of a golf ball having numerous dimples on its surface, a data constellation regarding a parameter dependent on a surface shape of the golf ball is calculated. Preferably, the parameter is a distance between an axis of the rotation and the surface of the golf ball. Another preferable parameter is a volume of space between a surface of a phantom sphere and the surface of the golf ball. Based on a maximum value and a minimum value of the data constellation, a fluctuation range is calculated. By dividing the fluctuation range by a total volume of the dimples, an evaluation value is calculated. This value is calculated for each of PH rotation and POP rotation.

6 Claims, 19 Drawing Sheets

GOLF BALL

This application is a Divisional of U.S. application Ser. No. 12/345,739, filed on Dec. 30, 2008 now U.S. Pat. No. 8,202,177, which claims priority on Patent Application No. 2008-14839 filed in JAPAN on Jan. 25, 2008. The entire contents of all of the above applications are hereby incorporated by reference.

BACKGROUND OF THE INVENTION

1. Field of the Invention

The present invention relates to golf balls. In particular, the present invention relates to the dimple patterns of golf balls.

2. Description of the Related Art

Golf balls have numerous dimples on the surface thereof. The dimples disturb the air flow around the golf ball during flight to cause turbulent flow separation. By causing the turbulent flow separation, separation points of the air from the golf ball surface shift backwards leading to the reduction of a drag. The turbulent flow separation promotes the displacement between the separating point on the upper side and the separating point on the lower side of the golf ball, which results from the backspin, thereby enhancing the lift force that acts upon the golf ball. The reduction of the drag and the enhancement of the lift force are referred to as a "dimple effect".

The United States Golf Association (USGA) has established the rules about symmetry of golf balls. According to the rules, the trajectories during PH (pole horizontal) rotation and the trajectories during POP (pole over pole) rotation are compared with each other. A golf ball having a large difference between these two trajectories, that is, inferior aerodynamic symmetry, does not be conformed to the rules. A golf ball with inferior aerodynamic symmetry has a short flight distance because the aerodynamic characteristic of the golf ball for PH rotation or for POP rotation is inferior. The rotation axis for PH rotation possesses through the poles of the golf ball, and the rotation axis for POP rotation is orthogonal to the rotation axis for PH rotation.

The dimples can be arranged by using a regular polyhedron that is inscribed in a phantom sphere of a golf ball. In this arrangement method, the surface of the phantom sphere is divided into a plurality of units by division lines obtained by projecting the sides of the polyhedron on the spherical surface. The dimple pattern of one unit is developed all over the phantom sphere. According to this dimple pattern, the aerodynamic characteristic in the case where a line passing through a vertex of the regular polyhedron is a rotation axis is different from that in the case where a line passing through a center of a surface of the regular polyhedron is a rotation axis. Such a golf ball has inferior aerodynamic symmetry.

JP-A-S50-8630 discloses a golf ball having an improved dimple pattern. The surface of the golf ball is divided by an icosahedron that is inscribed in the phantom sphere thereof. Based on this division, dimples are arranged on the surface of the golf ball. According to this dimple pattern, the number of great circles that do not intersect any dimples is 1. This great circle is identical with an equator of the golf ball. The region near the equator is a unique region.

Generally, a golf ball is formed with a mold having upper and lower mold halves. The mold has a parting line. A golf ball obtained with this mold has a seam at a position along the parting line. Through this forming, spew occurs along the seam. The spew is removed by means of cutting. By cutting the spew, the dimples near the seam are deformed. In addition, the dimples near the seam tend to be orderly arranged. The seam is located along the equator of the golf ball. The region near the equator is a unique region.

A mold having a corrugated parting line has been used. A golf ball obtained with this mold has dimples on the equator thereof. The dimples on the equator contribute to eliminating the uniqueness of the region near the equator. However, the uniqueness is not sufficiently eliminated. This golf ball has insufficient aerodynamic symmetry.

U.S. Pat. No. 4,744,564 (JP-A-S61-284264) discloses a golf ball in which the dimples near the seam are greater in volume than the dimples near the poles. This volume difference contributes to eliminating the uniqueness of the region near the equator.

A golf ball disclosed in U.S. Pat. No. 4,744,564 eliminates, by the volume difference of dimple, the disadvantage caused by the dimple pattern. The disadvantage is eliminated not by modification of the dimple pattern. In the golf ball, the potential of the dimple pattern is sacrificed. The flight distance of the golf ball is insufficient.

Research has been conducted to determine the causes of the uniqueness of the region near the equator, and the consequent insufficient symmetry and flight distance. However, the causes have not been cleared yet, and a general theory for the improvements has not been established. In the conventional development of golf balls, design, experimental production, and evaluation are conducted through trials and errors.

An objective of the present invention is to provide a golf ball having excellent aerodynamic symmetry and a long flight distance. Another objective of the present invention is to provide a method for easily and accurately evaluating the aerodynamic characteristic of a golf ball.

SUMMARY OF THE INVENTION

The inventors of the present invention have found, as a result of thorough research, that aerodynamic symmetry and a flight distance depend heavily on a specific parameter. Based on this finding, the inventors have completed a method for evaluating a golf ball with high accuracy. In addition, by using the evaluation method, the inventors have completed creating a golf ball having excellent aerodynamic symmetry and a long flight distance.

An evaluation method according to the present invention comprises:

a calculation step of calculating a data constellation, regarding a parameter dependent on a surface shape of a golf ball having numerous dimples on its surface, based on a surface shape appearing at a predetermined point moment by moment during rotation of the golf ball; and a determination step of determining an aerodynamic characteristic of the golf ball based on the data constellation.

Preferably, at the determination step, the aerodynamic characteristic of the golf ball is determined based on a fluctuation range of the data constellation. Preferably, at the calculation step, the data constellation is calculated throughout one rotation of the golf ball. Preferably, at the calculation step, the data constellation is calculated based on a shape of a surface near a great circle orthogonal to an axis of the rotation.

Preferably, at the calculation step, the data constellation is calculated based on a parameter dependent on a distance between an axis of the rotation and the surface of the golf ball. At the calculation step, the data constellation may be calculated based on a parameter dependent on a volume of space between a surface of a phantom sphere and the surface of the golf ball.

Another evaluation method according to the present invention comprises:

a first calculation step of calculating a first data constellation, regarding a parameter dependent on a surface shape of a golf ball having numerous dimples on its surface, based on a surface shape appearing at a predetermined point moment by moment during rotation of the golf ball about a first axis;

a second calculation step of calculating a second data constellation, regarding a parameter dependent on the surface shape of the golf ball, based on a surface shape appearing at a predetermined point moment by moment during rotation of the golf ball about a second axis; and a determination step of determining an aerodynamic characteristic of the golf ball based on comparison of the first data constellation and the second data constellation.

Preferably, the aerodynamic characteristic determined at the determination step is aerodynamic symmetry.

A golf ball designing process according to the present invention comprises:

a step of determining positions and shapes of numerous dimples located on a surface of a golf ball;

a calculation step of calculating a data constellation, regarding a parameter dependent on a surface shape of the golf ball, based on a surface shape appearing at a predetermined point moment by moment during rotation of the golf ball;

a determination step of determining an aerodynamic characteristic of the golf ball based on the data constellation; and a step of changing the positions or the shapes of the dimples when the aerodynamic characteristic is insufficient.

A golf ball according to the present invention has values Ad1 and Ad2 which are obtained by the following steps (1) to (18):

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining, among the surface of the phantom sphere, a region sandwiched between the two small circles by dividing the phantom sphere at the two small circles;

(5) determining 30240 points arranged at an interval of a central angle of 3° in a direction of the first rotation axis and at an interval of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated based on 21 perpendicular lines arranged in the direction of the first rotation axis;

(8) determining a maximum value and a minimum value among 1440 total lengths L2 calculated along the direction of rotation about the first rotation axis, and calculating a fluctuation range by subtracting the minimum value from the maximum value;

(9) calculating the value Ad1 by dividing the fluctuation range by a total volume of dimples;

(10) assuming a second rotation axis orthogonal to the first rotation axis assumed at the step (1);

(11) assuming a great circle which exists on the surface of the phantom sphere of the golf ball and is orthogonal to the second rotation axis;

(12) assuming two small circles which exist on the surface of the phantom sphere of the golf ball, which are orthogonal to the second rotation axis, and of which an absolute value of a central angle with the great circle is 30°;

(13) defining, among the surface of the phantom sphere, a region sandwiched between the two small circles by dividing the phantom sphere at the two small circles;

(14) determining 30240 points arranged at an interval of a central angle of 3° in a direction of the second rotation axis and at an interval of a central angle of 0.25° in a direction of rotation about the second rotation axis;

(15) calculating a length L1 of a perpendicular line which extends from each point to the second rotation axis;

(16) calculating a total length L2 by summing 21 lengths L1 calculated based on 21 perpendicular lines arranged in the direction of the second rotation axis;

(17) determining a maximum value and a minimum value among 1440 total lengths L2 calculated along the direction of rotation about the second rotation axis, and calculating a fluctuation range by subtracting the minimum value from the maximum value; and

(18) calculating the value Ad2 by dividing the fluctuation range by the total volume of the dimples. The values Ad1 and Ad2 are equal to or less than 0.009 $mm^{-2}$.

Preferably, an absolute value of a difference between the values Ad1 and Ad2 is equal to or less than 0.005 $mm^{-2}$.

Another golf ball according to the present invention has values Ad3 and Ad4 which are obtained by the following steps (1) to (16):

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining, among the phantom sphere, a region sandwiched between the two small circles by dividing the phantom sphere at the two small circles;

(5) assuming 120 minute regions by dividing the region at an interval of a central angle of 3° in a direction of rotation about the first rotation axis;

(6) calculating a volume of space between the surface of the phantom sphere and a surface of the golf ball in each minute region;

(7) determining a maximum value and a minimum value among the 120 volumes calculated along the direction of rotation about the first rotation axis, and calculating a fluctuation range by subtracting the minimum value from the maximum value;

(8) calculating the value Ad3 by dividing the fluctuation range by a total volume of dimples;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining, among the phantom sphere, a region sandwiched between the two small circles by dividing the phantom sphere at the two small circles;

(13) assuming 120 minute regions by dividing the region at an interval of a central angle of 3° in a direction of rotation about the second rotation axis;

(14) calculating a volume of space between the surface of the phantom sphere and a surface of the golf ball in each minute region;

(15) determining a maximum value and a minimum value among the 120 volumes calculated along the direction of rotation about the second rotation axis, and calculating a fluctuation range by subtracting the minimum value from the maximum value; and

(16) calculating the value Ad4 by dividing the fluctuation range by a total volume of dimples.

The values Ad3 and Ad4 which are equal to or less than 0.008.

Preferably, an absolute value of a difference between the values Ad3 and Ad4 is equal to or less than 0.003.

DESCRIPTION OF THE PREFERRED EMBODIMENTS

The following will describe in detail the present invention based on preferred embodiments with reference to the accompanying drawings.

Figure 1:
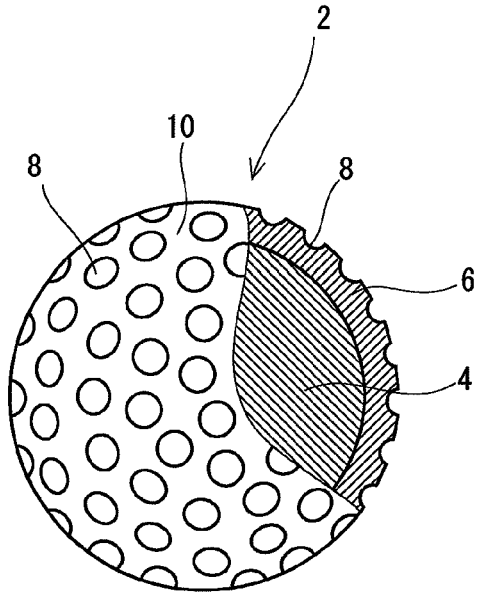
FIG. 1 is a schematic cross-sectional view of a golf ball according to one embodiment of the present invention.

Golf ball 2 shown in FIG. 1 includes a spherical core 4 and a cover 6. On the surface of the cover 6, numerous dimples 8 are formed. Of the surface of the golf ball 2, a part except for the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of 40 mm or greater and 45 mm or less. From the standpoint of conformity to the rules established by the United States Golf Association (USGA), the diameter is preferably equal to or greater than 42.67 mm. In light of suppression of the air resistance, the diameter is more preferably equal to or less than 44 mm, and particularly preferably equal to or less than 42.80 mm. The golf ball 2 has a weight of 40 g or greater and 50 g or less. In light of attainment of great inertia, the weight is more preferably equal to or greater than 44 g, and particularly preferably equal to or greater than 45.00 g. From the standpoint of conformity to the rules established by the USGA, the weight is particularly preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more types of rubbers may be used in combination. In light of resilience performance, polybutadienes are preferred, and high-cis polybutadiene is particularly preferred.

In order to crosslink the core 4, a co-crosslinking agent can be used. Preferable examples of co-crosslinking agent in light of resilience performance include zinc acrylate, magnesium acrylate, zinc methacrylate, and magnesium methacrylate. Preferably, the rubber compound includes an organic peroxide together with a co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

The rubber composition for the core 4 may include various additives, such as a sulfur compound, a filler, an anti-aging agent, a coloring agent, a plasticizer, and a dispersant at an adequate amount as needed. The rubber composition may include a crosslinked rubber powder or a synthetic resin powder.

The core 4 has a diameter of preferably 30.0 mm or greater, particularly preferably 38.0 mm or greater. The core 4 has a diameter of preferably 42.0 mm or less, and particularly preferably 41.5 mm or less. The core 4 may be formed with two or more layers.

One example of suitable polymer for the cover 6 is ionomer resin. Examples of preferable ionomer resin include binary copolymers formed with α-olefin and an α,β-unsaturated carboxylic acid having 3 to 8 carbon atoms. Other examples of preferable ionomer resin include ternary copolymers formed with α-olefin, an α,β-unsaturated carboxylic acid having 3 to 8 carbon atoms and an α,β-unsaturated carboxylate ester having 2 to 22 carbon atoms. In the binary copolymer and ternary copolymer, preferable α-olefin is ethylene and propylene, while preferable α,β-unsaturated carboxylic acid is acrylic acid and methacrylic acid. In the binary copolymer and ternary copolymer, a part of carboxyl groups is neutralized with a metal ion. Some of the metal ion for neutralization are sodium ion, potassium ion, lithium ion, zinc ion, calcium ion, magnesium ion, aluminum ion, and neodymium ion.

Other polymer may be used instead of or together with ionomer resin. Examples of the other polymer include thermoplastic polyurethane elastomers, thermoplastic styrene elastomers, thermoplastic polyamide elastomers, thermoplastic polyester elastomers, and thermoplastic polyolefin elastomers.

A coloring agent such as titanium dioxide, a filler such as barium sulfate, a dispersant, an antioxidant, an ultraviolet absorber, a light stabilizer, a fluorescent material and a fluorescent brightener are blended into the cover 6 at an adequate amount as needed. For the purpose of adjusting specific gravity, powder of a metal with a high specific gravity such as tungsten and molybdenum may be blended with the cover 6.

The cover 6 has a thickness of preferably 0.3 mm or greater and particularly preferably 0.5 mm or greater. The cover 6 has a thickness of preferably 2.5 mm or less and particularly preferably 2.2 mm or less. The cover 6 has a specific gravity of preferably 0.90 or greater and particularly preferably 0.95 or greater. The cover 6 has a specific gravity of preferably 1.10 or less and particularly preferably 1.05 or less. The cover 6 may be formed with two or more layers.

Figure 2:
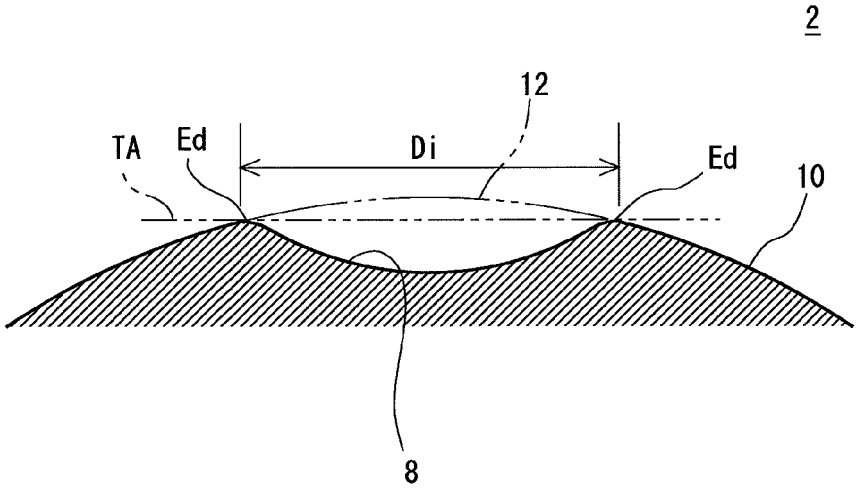
FIG. 2 is a partially enlarged cross-sectional view of the golf ball in FIG. 1.

FIG. 2 shows a partially enlarged cross-sectional view of the golf ball 2 in FIG. 1. In FIG. 2, a cross section along a plane passing through the center (deepest part) of the dimple 8 and the center of the golf ball 2 is shown. In FIG. 2, the top-to-bottom direction is the depth direction of the dimple 8. What is indicated by a chain double-dashed line in FIG. 2 is the surface of a phantom sphere 12. The surface of the phantom sphere 12 corresponds to the surface of the golf ball 2 when it is postulated that no dimple 8 exists. The dimple 8 is recessed from the surface of the phantom sphere 12. The land 10 agrees with the surface of the phantom sphere 12.

In FIG. 2, what is indicated by a double ended arrow Di is the diameter of the dimple 8. This diameter Di is a distance between two tangent points Ed appearing on a tangent line TA which is drawn tangent to the far opposite ends of the dimple 8. The tangent point Ed is also a edge of the dimple 8. The edge Ed defines the contour of the dimple 8. The diameter Di is preferably 2.00 mm or greater and 6.00 mm or less. By setting the diameter Di to be equal to or greater than 2.00 mm, great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, fundamental feature of the golf ball 2 being substantially a sphere is not impaired. In this respect, the diameter Di is more preferably equal to or less than 5.80 mm, and particularly preferably equal to or less than 5.60 mm.

Figure 3:
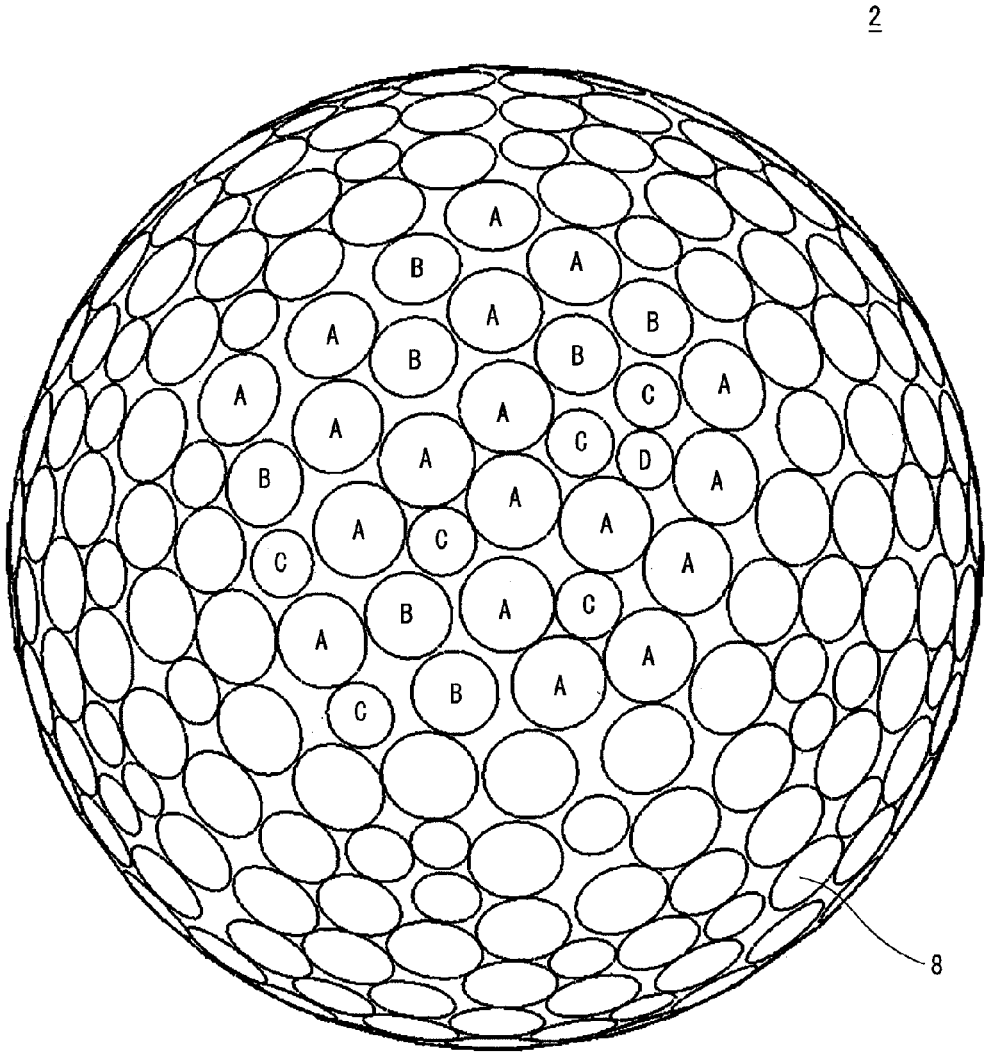
FIG. 3 is an enlarged front view of the golf ball in FIG. 1.
Figure 4:
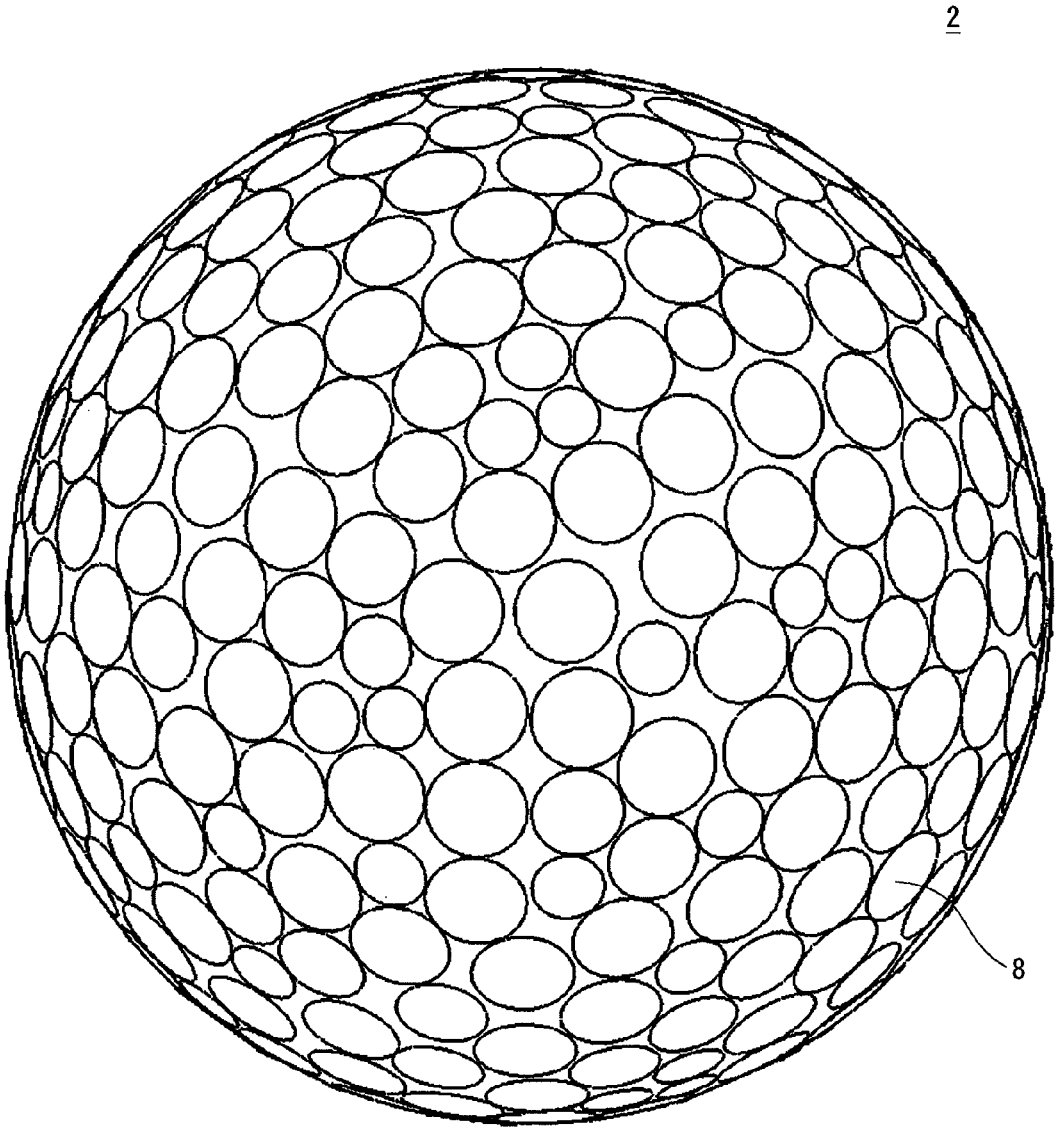
FIG. 4 is a plan view of the golf ball in FIG. 3.

FIG. 3 shows an enlarged front view of the golf ball 2 in FIG. 1. FIG. 4 shows a plan view of the golf ball 2 in FIG. 3. In FIG. 3, when the surface of the golf ball 2 is divided into 12 units, kinds of the dimples 8 in one unit are indicated by the reference signs A to D. All the dimples 8 have a circular plane shape. The golf ball 2 has dimples A with a diameter of 4.20 mm, dimples B with a diameter of 3.80 mm, dimples C with a diameter of 3.00 mm, and dimples D with a diameter of 2.60 mm. The dimple pattern of this unit is developed all over the surface of the golf ball 2. When developing the dimple pattern, the positions of the dimples 8 are finely adjusted for each unit. The number of the dimples A is 216; the number of the dimples B is 84; the number of the dimples C is 72; and the number of the dimples D is 12. The total number of the dimples 8 is 384. The latitude and longitude of these dimples 8 are shown in the following Tables 1 to 5.

TABLE 1

| Dimple Arrangement | | | |
|---|---|---|---|
| | Kind | Latitude (degree) | Longitude (degree) |
| 1 | A | 85.691 | 67.318 |
| 2 | A | 81.286 | 199.300 |
| 3 | A | 81.286 | 280.700 |
| 4 | A | 75.987 | 334.897 |
| 5 | A | 75.987 | 145.103 |
| 6 | A | 75.303 | 23.346 |

TABLE 1-continued

| Dimple Arrangement | | | |
|---|---|---|---|
| | Kind | Latitude (degree) | Longitude (degree) |
| 7 | A | 71.818 | 100.896 |
| 8 | A | 65.233 | 133.985 |
| 9 | A | 65.233 | 346.016 |
| 10 | A | 65.189 | 39.055 |
| 11 | A | 65.060 | 75.516 |
| 12 | A | 61.445 | 158.091 |
| 13 | A | 61.445 | 321.909 |
| 14 | A | 61.070 | 252.184 |
| 15 | A | 61.070 | 227.816 |
| 16 | A | 60.647 | 108.080 |
| 17 | A | 57.147 | 58.461 |
| 18 | A | 55.279 | 288.525 |
| 19 | A | 55.279 | 191.475 |
| 20 | A | 54.062 | 211.142 |
| 21 | A | 54.062 | 268.858 |
| 22 | A | 54.041 | 350.081 |
| 23 | A | 53.504 | 126.971 |
| 24 | A | 53.069 | 307.598 |
| 25 | A | 53.069 | 172.402 |
| 26 | A | 49.772 | 228.202 |
| 27 | A | 49.526 | 107.190 |
| 28 | A | 49.456 | 249.324 |
| 29 | A | 47.660 | 15.660 |
| 30 | A | 47.244 | 67.559 |
| 31 | A | 46.729 | 50.974 |
| 32 | A | 46.350 | 323.515 |
| 33 | A | 46.350 | 156.485 |
| 34 | A | 45.673 | 34.636 |
| 35 | A | 44.933 | 339.633 |
| 36 | A | 44.933 | 140.367 |
| 37 | A | 44.882 | 295.495 |
| 38 | A | 44.882 | 184.505 |
| 39 | A | 44.242 | 359.196 |
| 40 | A | 42.196 | 120.253 |
| 41 | A | 40.522 | 237.865 |
| 42 | A | 36.705 | 73.432 |
| 43 | A | 36.500 | 11.475 |
| 44 | A | 36.079 | 45.962 |
| 45 | A | 35.806 | 193.343 |
| 46 | A | 35.806 | 286.657 |
| 47 | A | 35.713 | 250.884 |
| 48 | A | 35.005 | 131.984 |
| 49 | A | 34.833 | 177.642 |
| 50 | A | 34.833 | 302.358 |
| 51 | A | 34.560 | 207.408 |
| 52 | A | 34.560 | 272.592 |
| 53 | A | 33.900 | 86.867 |
| 54 | A | 30.252 | 359.718 |
| 55 | A | 30.080 | 119.572 |
| 56 | A | 29.307 | 239.817 |
| 57 | A | 26.977 | 337.630 |
| 58 | A | 26.967 | 217.628 |
| 59 | A | 26.522 | 53.578 |
| 60 | A | 26.233 | 313.918 |
| 61 | A | 26.233 | 166.082 |
| 62 | A | 25.945 | 77.590 |
| 63 | A | 25.668 | 199.232 |
| 64 | A | 25.668 | 280.768 |
| 65 | A | 25.588 | 40.979 |
| 66 | A | 23.737 | 107.042 |
| 67 | A | 22.987 | 91.662 |
| 68 | A | 20.802 | 269.276 |
| 69 | A | 20.537 | 29.857 |
| 70 | A | 19.971 | 149.439 |
| 71 | A | 18.932 | 325.930 |
| 72 | A | 18.877 | 118.043 |
| 73 | A | 18.548 | 209.356 |
| 74 | A | 17.974 | 1.141 |
| 75 | A | 17.973 | 241.141 |
| 76 | A | 16.138 | 138.223 |
| 77 | A | 15.811 | 220.861 |
| 78 | A | 15.723 | 161.053 |
| 79 | A | 15.558 | 340.213 |
| 80 | A | 15.057 | 54.091 |

TABLE 2

| Dimple Arrangement | | | |
|---|---|---|---|
| | Kind | Latitude (degree) | Longitude (degree) |
| 81 | A | 15.011 | 66.203 |
| 82 | A | 14.992 | 186.255 |
| 83 | A | 14.535 | 312.879 |
| 84 | A | 14.152 | 282.171 |
| 85 | A | 14.107 | 77.896 |
| 86 | A | 14.065 | 197.945 |
| 87 | A | 11.930 | 127.300 |
| 88 | A | 11.464 | 351.579 |
| 89 | A | 11.459 | 231.583 |
| 90 | A | 9.454 | 267.333 |
| 91 | A | 9.446 | 27.328 |
| 92 | A | 8.895 | 147.125 |
| 93 | A | 7.578 | 116.668 |
| 94 | A | 6.950 | 301.950 |
| 95 | A | 6.664 | 2.030 |
| 96 | A | 6.663 | 242.035 |
| 97 | A | 5.164 | 289.168 |
| 98 | A | 4.715 | 158.076 |
| 99 | A | 4.699 | 71.498 |
| 100 | A | 4.677 | 38.046 |
| 101 | A | 4.670 | 191.529 |
| 102 | A | 4.386 | 169.415 |
| 103 | A | 4.370 | 49.384 |
| 104 | A | 4.189 | 104.832 |
| 105 | A | 3.868 | 253.091 |
| 106 | A | 3.866 | 13.085 |
| 107 | A | 3.702 | 277.673 |
| 108 | A | 3.284 | 343.658 |
| 109 | A | 3.276 | 223.664 |
| 110 | A | −1.138 | 263.313 |
| 111 | A | −1.145 | 23.305 |
| 112 | A | −3.156 | 296.805 |
| 113 | A | −3.730 | 117.727 |
| 114 | A | −5.028 | 98.222 |
| 115 | A | −5.301 | 66.255 |
| 116 | A | −5.320 | 186.266 |
| 117 | A | −5.560 | 1.243 |
| 118 | A | −5.562 | 241.252 |
| 119 | A | −5.603 | 174.914 |
| 120 | A | −5.608 | 54.904 |
| 121 | A | −6.610 | 77.578 |
| 122 | A | −6.651 | 197.586 |
| 123 | A | −6.740 | 316.100 |
| 124 | A | −9.310 | 219.881 |
| 125 | A | −9.379 | 327.238 |
| 126 | A | −9.834 | 338.778 |
| 127 | A | −11.302 | 139.305 |
| 128 | A | −11.465 | 304.650 |
| 129 | A | −11.656 | 258.951 |
| 130 | A | −11.661 | 18.940 |
| 131 | A | −13.404 | 89.766 |
| 132 | A | −13.611 | 208.915 |
| 133 | A | −13.916 | 293.296 |
| 134 | A | −14.848 | 128.252 |
| 135 | A | −14.902 | 247.791 |
| 136 | A | −14.902 | 7.778 |
| 137 | A | −14.989 | 104.117 |
| 138 | A | −15.045 | 116.532 |
| 139 | A | −15.350 | 60.821 |
| 140 | A | −15.357 | 180.810 |
| 141 | A | −15.509 | 150.296 |
| 142 | A | −15.563 | 30.304 |
| 143 | A | −15.581 | 281.633 |
| 144 | A | −16.386 | 269.878 |
| 145 | A | −20.645 | 328.793 |
| 146 | A | −21.042 | 311.017 |
| 147 | A | −23.090 | 19.912 |
| 148 | A | −23.809 | 172.748 |
| 149 | A | −23.819 | 52.779 |
| 150 | A | −24.625 | 69.349 |
| 151 | A | −24.650 | 189.318 |
| 152 | A | −25.075 | 261.401 |
| 153 | A | −25.417 | 133.803 |
| 154 | A | −25.453 | 156.111 |
| 155 | A | −25.495 | 36.142 |

TABLE 2-continued

| Dimple Arrangement | | | |
|---|---|---|---|
| | Kind | Latitude (degree) | Longitude (degree) |
| 156 | A | −25.836 | 276.531 |
| 157 | A | −25.899 | 100.191 |
| 158 | A | −26.295 | 4.604 |
| 159 | A | −26.501 | 351.270 |
| 160 | A | −26.527 | 248.419 |

TABLE 3

| Dimple Arrangement | | | |
|---|---|---|---|
| | Kind | Latitude (degree) | Longitude (degree) |
| 161 | A | −28.009 | 338.630 |
| 162 | A | −28.872 | 320.134 |
| 163 | A | −29.656 | 216.752 |
| 164 | A | −33.266 | 165.532 |
| 165 | A | −33.289 | 45.587 |
| 166 | A | −33.571 | 26.465 |
| 167 | A | −34.810 | 121.946 |
| 168 | A | −34.881 | 92.123 |
| 169 | A | −35.921 | 70.481 |
| 170 | A | −35.948 | 190.419 |
| 171 | A | −35.969 | 106.249 |
| 172 | A | −36.237 | 241.545 |
| 173 | A | −36.677 | 269.561 |
| 174 | A | −36.780 | 309.211 |
| 175 | A | −38.058 | 3.003 |
| 176 | A | −40.005 | 57.051 |
| 177 | A | −41.376 | 295.414 |
| 178 | A | −41.680 | 176.151 |
| 179 | A | −42.945 | 217.442 |
| 180 | A | −44.210 | 21.410 |
| 181 | A | −44.278 | 258.399 |
| 182 | A | −44.396 | 320.927 |
| 183 | A | −44.500 | 159.270 |
| 184 | A | −44.941 | 115.286 |
| 185 | A | −44.961 | 279.798 |
| 186 | A | −46.360 | 142.796 |
| 187 | A | −48.437 | 243.048 |
| 188 | A | −49.314 | 5.102 |
| 189 | A | −49.778 | 68.092 |
| 190 | A | −50.602 | 188.133 |
| 191 | A | −52.599 | 226.337 |
| 192 | A | −52.972 | 309.720 |
| 193 | A | −52.982 | 127.612 |
| 194 | A | −53.185 | 348.010 |
| 195 | A | −53.519 | 169.798 |
| 196 | A | −54.005 | 207.538 |
| 197 | A | −54.153 | 290.081 |
| 198 | A | −54.419 | 88.781 |
| 199 | A | −54.511 | 328.756 |
| 200 | A | −55.417 | 108.606 |
| 201 | A | −56.454 | 49.583 |
| 202 | A | −59.768 | 242.157 |
| 203 | A | −60.664 | 3.667 |
| 204 | A | −61.192 | 142.183 |
| 205 | A | −61.580 | 72.132 |
| 206 | A | −62.555 | 192.606 |
| 207 | A | −63.591 | 27.254 |
| 208 | A | −64.742 | 166.150 |
| 209 | A | −71.117 | 239.508 |
| 210 | A | −71.895 | 0.773 |
| 211 | A | −73.954 | 321.276 |
| 212 | A | −75.160 | 276.770 |
| 213 | A | −75.592 | 156.215 |
| 214 | A | −81.496 | 104.116 |
| 215 | A | −83.209 | 358.182 |
| 216 | A | −83.703 | 222.567 |
| 217 | B | 71.726 | 222.962 |
| 218 | B | 71.726 | 257.038 |
| 219 | B | 65.062 | 12.846 |

TABLE 3-continued

| Dimple Arrangement | | | |
|---|---|---|---|
| | Kind | Latitude (degree) | Longitude (degree) |
| 220 | B | 64.201 | 204.125 |
| 221 | B | 64.201 | 275.875 |
| 222 | B | 56.523 | 25.705 |
| 223 | B | 44.733 | 202.702 |
| 224 | B | 44.733 | 277.298 |
| 225 | B | 44.730 | 82.887 |
| 226 | B | 42.191 | 217.140 |
| 227 | B | 42.191 | 262.860 |
| 228 | B | 41.735 | 96.344 |
| 229 | B | 36.680 | 330.394 |
| 230 | B | 36.680 | 149.606 |
| 231 | B | 36.636 | 317.227 |
| 232 | B | 36.636 | 162.773 |
| 233 | B | 36.073 | 348.257 |
| 234 | B | 35.785 | 60.068 |
| 235 | B | 35.768 | 108.197 |
| 236 | B | 34.642 | 226.451 |
| 237 | B | 33.690 | 32.733 |
| 238 | B | 29.217 | 21.434 |
| 239 | B | 28.939 | 260.890 |
| 240 | B | 28.206 | 141.817 |

TABLE 4

| Dimple Arrangement | | | |
|---|---|---|---|
| | Kind | Latitude (degree) | Longitude (degree) |
| 241 | B | 26.112 | 65.597 |
| 242 | B | 26.015 | 292.775 |
| 243 | B | 26.015 | 187.225 |
| 244 | B | 24.460 | 250.577 |
| 245 | B | 24.459 | 10.579 |
| 246 | B | 24.275 | 130.633 |
| 247 | B | 24.145 | 349.181 |
| 248 | B | 24.139 | 229.180 |
| 249 | B | 15.512 | 293.264 |
| 250 | B | 15.320 | 173.775 |
| 251 | B | 14.775 | 41.979 |
| 252 | B | 13.715 | 99.702 |
| 253 | B | 8.740 | 331.201 |
| 254 | B | 8.205 | 212.585 |
| 255 | B | 6.028 | 60.110 |
| 256 | B | 6.022 | 180.144 |
| 257 | B | 5.563 | 136.285 |
| 258 | B | 4.862 | 93.872 |
| 259 | B | 4.358 | 82.630 |
| 260 | B | 4.307 | 202.659 |
| 261 | B | 3.795 | 313.779 |
| 262 | B | 0.913 | 323.942 |
| 263 | B | −1.407 | 143.793 |
| 264 | B | −4.880 | 163.968 |
| 265 | B | −4.907 | 43.957 |
| 266 | B | −5.030 | 284.024 |
| 267 | B | −5.184 | 153.695 |
| 268 | B | −5.231 | 33.684 |
| 269 | B | −6.134 | 273.262 |
| 270 | B | −6.841 | 230.478 |
| 271 | B | −6.845 | 349.569 |
| 272 | B | −15.871 | 235.789 |
| 273 | B | −16.146 | 354.934 |
| 274 | B | −18.714 | 79.067 |
| 275 | B | −18.758 | 199.051 |
| 276 | B | −23.971 | 288.774 |
| 277 | B | −26.108 | 112.218 |
| 278 | B | −26.223 | 236.362 |
| 279 | B | −29.185 | 80.517 |
| 280 | B | −29.232 | 200.478 |
| 281 | B | −33.697 | 285.117 |
| 282 | B | −34.334 | 228.527 |
| 283 | B | −35.520 | 150.290 |

TABLE 4-continued

| Dimple Arrangement | | | |
|---|---|---|---|
| | Kind | Latitude (degree) | Longitude (degree) |
| 284 | B | −36.149 | 330.142 |
| 285 | B | −36.438 | 136.825 |
| 286 | B | −41.409 | 35.857 |
| 287 | B | −42.609 | 82.467 |
| 288 | B | −43.798 | 200.849 |
| 289 | B | −45.001 | 97.037 |
| 290 | B | −45.076 | 336.769 |
| 291 | B | −51.775 | 32.952 |
| 292 | B | −63.684 | 311.963 |
| 293 | B | −64.471 | 216.578 |
| 294 | B | −64.482 | 96.287 |
| 295 | B | −64.561 | 336.711 |
| 296 | B | −64.843 | 263.144 |
| 297 | B | −64.922 | 287.410 |
| 298 | B | −72.192 | 77.689 |
| 299 | B | −73.119 | 198.413 |
| 300 | B | −74.983 | 38.997 |
| 301 | C | 74.657 | 63.484 |
| 302 | C | 71.768 | 190.178 |
| 303 | C | 71.768 | 289.822 |
| 304 | C | 62.942 | 179.469 |
| 305 | C | 62.942 | 300.531 |
| 306 | C | 56.191 | 7.848 |
| 307 | C | 55.053 | 77.053 |
| 308 | C | 54.553 | 41.717 |
| 309 | C | 53.846 | 333.327 |
| 310 | C | 53.846 | 146.673 |
| 311 | C | 51.471 | 92.182 |
| 312 | C | 43.387 | 308.955 |
| 313 | C | 43.387 | 171.045 |
| 314 | C | 39.782 | 24.035 |
| 315 | C | 30.483 | 99.122 |
| 316 | C | 28.904 | 324.540 |
| 317 | C | 28.904 | 155.460 |
| 318 | C | 25.096 | 177.021 |
| 319 | C | 25.096 | 302.979 |
| 320 | C | 19.173 | 19.184 |

TABLE 5

| Dimple Arrangement | | | |
|---|---|---|---|
| | Kind | Latitude (degree) | Longitude (degree) |
| 321 | C | 19.031 | 258.510 |
| 322 | C | 16.665 | 302.816 |
| 323 | C | 13.992 | 109.225 |
| 324 | C | 13.490 | 250.202 |
| 325 | C | 13.489 | 10.199 |
| 326 | C | 13.283 | 88.625 |
| 327 | C | 9.824 | 321.654 |
| 328 | C | 2.241 | 125.798 |
| 329 | C | 1.894 | 353.532 |
| 330 | C | 1.889 | 233.538 |
| 331 | C | −0.688 | 333.972 |
| 332 | C | −0.779 | 214.792 |
| 333 | C | −1.916 | 306.499 |
| 334 | C | −3.246 | 133.810 |
| 335 | C | −3.817 | 86.960 |
| 336 | C | −3.875 | 206.975 |
| 337 | C | −5.619 | 108.070 |
| 338 | C | −5.643 | 251.068 |
| 339 | C | −5.645 | 11.059 |
| 340 | C | −13.167 | 160.039 |
| 341 | C | −13.201 | 40.044 |
| 342 | C | −13.992 | 70.775 |
| 343 | C | −14.020 | 190.767 |
| 344 | C | −14.119 | 169.982 |
| 345 | C | −14.134 | 49.990 |
| 346 | C | −15.855 | 319.691 |
| 347 | C | −18.820 | 342.978 |

TABLE 5-continued

| Dimple Arrangement | | | |
|---|---|---|---|
| | Kind | Latitude (degree) | Longitude (degree) |
| 348 | C | −19.621 | 218.069 |
| 349 | C | −20.962 | 227.066 |
| 350 | C | −21.132 | 300.259 |
| 351 | C | −23.321 | 88.424 |
| 352 | C | −23.382 | 208.402 |
| 353 | C | −24.157 | 122.583 |
| 354 | C | −25.238 | 144.976 |
| 355 | C | −30.175 | 296.333 |
| 356 | C | −30.604 | 60.620 |
| 357 | C | −30.611 | 180.571 |
| 358 | C | −33.028 | 14.319 |
| 359 | C | −35.296 | 253.537 |
| 360 | C | −36.369 | 208.069 |
| 361 | C | −37.100 | 342.734 |
| 362 | C | −43.286 | 128.706 |
| 363 | C | −43.365 | 231.100 |
| 364 | C | −43.751 | 352.045 |
| 365 | C | −46.901 | 46.162 |
| 366 | C | −53.473 | 153.219 |
| 367 | C | −54.282 | 257.158 |
| 368 | C | −54.735 | 18.266 |
| 369 | C | −57.211 | 273.655 |
| 370 | C | −62.936 | 120.983 |
| 371 | C | −66.376 | 49.500 |
| 372 | C | −71.885 | 110.989 |
| 373 | D | 69.657 | 168.114 |
| 374 | D | 69.657 | 311.886 |
| 375 | D | 58.920 | 90.139 |
| 376 | D | 11.497 | 258.235 |
| 377 | D | 11.492 | 18.232 |
| 378 | D | −5.801 | 126.695 |
| 379 | D | −19.739 | 163.893 |
| 380 | D | −19.766 | 43.912 |
| 381 | D | −28.169 | 304.659 |
| 382 | D | −35.660 | 351.929 |
| 383 | D | −50.268 | 268.667 |
| 384 | D | −69.514 | 132.796 |

From the standpoint that the individual dimples 8 contribute to the dimple effect, the average diameter of the dimples 8 is preferably equal to or greater than 3.5 mm, and more preferably equal to or greater than 3.8 mm. The average diameter is preferably equal to or less than 5.50 mm. By setting the average diameter to be equal to or less than 5.50 mm, fundamental feature of the golf ball 2 being substantially a sphere is not impaired. The golf ball 2 shown in FIGS. 3 and 4 has an average diameter of 3.84 mm.

Area s of the dimple 8 is an area of a region surrounded by the contour line when the center of the golf ball 2 is viewed at infinity. In the case of a circular dimple 8, the area s is calculated by the following formula.

$$S=(Di/2)^2*\pi$$

In the golf ball 2 shown in FIGS. 3 and 4, the area of the dimple A is 13.85 $mm^2$; the area of the dimple B is 11.34 $mm^2$; the area of the dimple C is 7.07 $mm^2$; and the area of the dimple D is 5.31 $mm^2$.

In the present invention, the ratio of the sum of the areas s of all the dimples 8 to the surface area of the phantom sphere 12 is referred to as an occupation ratio. From the standpoint that sufficient dimple effect is achieved, the occupation ratio is preferably equal to or greater than 70%, more preferably equal to or greater than 74%, and particularly preferably equal to or greater than 78%. The occupation ratio is preferably equal to or less than 95%. According to the golf ball 2 shown in FIGS. 3 and 4, the total area of the dimples 8 is 4516.9 $mm^2$. The surface area of the phantom sphere 12 of the golf ball 2 is 5728.0 $mm^2$, and thus the occupation ratio is 79%.

In light of suppression of rising of the golf ball 2 during flight, the depth of the dimple 8 is preferably equal to or greater than 0.05 mm, more preferably equal to or greater than 0.08 mm, and particularly preferably equal to or greater than 0.10 mm. In light of suppression of dropping of the golf ball 2 during flight, the depth of the dimple 8 is preferably equal to or less than 0.60 mm, more preferably equal to or less than 0.45 mm, and particularly preferably equal to or less than 0.40 mm. The depth is the distance between the tangent line TA and the deepest part of the dimple 8.

According to the present invention, the term "dimple volume" means the volume of a part surrounded by the surface of the dimple 8 and a plane that includes the contour of the dimple 8. In light of suppression of rising of the golf ball 2 during flight, the sum of the volumes (total volume) of all the dimples 8 is preferably equal to or greater than 240 $mm^3$, more preferably equal to or greater than 260 $mm^3$, and particularly preferably equal to or greater than 280 $mm^3$. In light of suppression of dropping of the golf ball 2 during flight, the total volume is preferably equal to or less than 400 $mm^3$, more preferably equal to or less than 380 $mm^3$, and particularly preferably equal to or less than 360 $mm^3$.

From the standpoint that sufficient occupation ratio can be achieved, the total number of the dimples 8 is preferably equal to or greater than 200, more preferably equal to or greater than 250, and particularly preferably equal to or greater than 300. From the standpoint that individual dimples 8 can have a sufficient diameter, the total number is preferably equal to or less than 500, more preferably equal to or less than 440, and particularly preferably equal to or less than 400.

Figure 5:
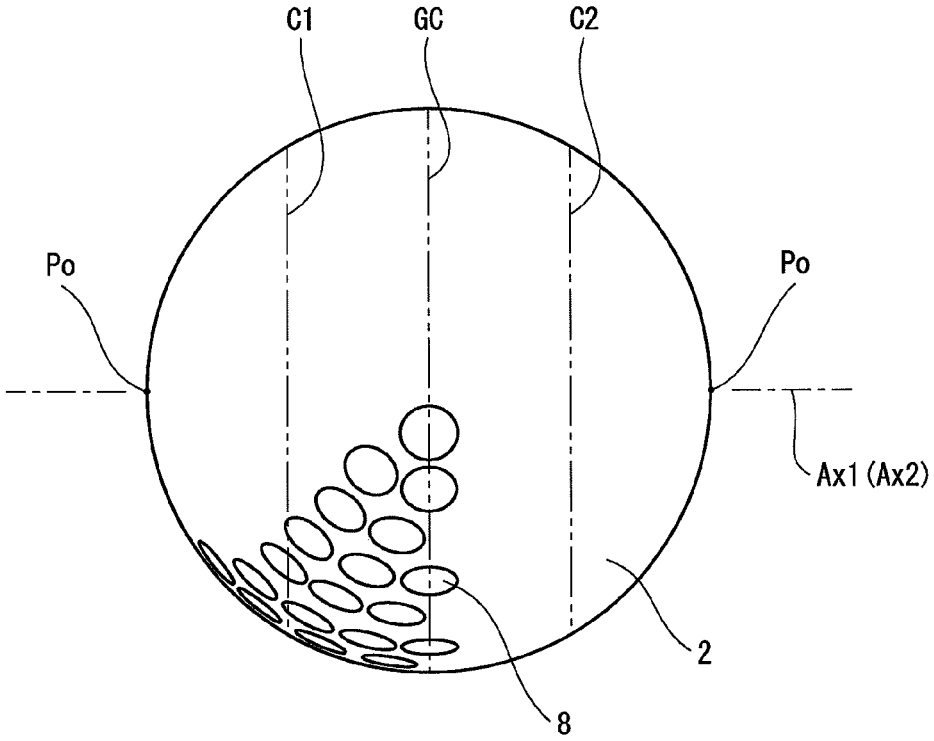
FIG. 5 is a schematic view for explaining an evaluation method according to one embodiment of the present invention.

The following will describe an evaluation method for aerodynamic characteristic according to the present invention. FIG. 5 shows a schematic view for explaining the evaluation method. In the evaluation method, a first rotation axis Ax1 is assumed. The first rotation axis Ax1 passes through the two poles Po of the golf ball 2. Each pole Po corresponds to the deepest part of the mold used for forming the golf ball 2. One of the poles Po corresponds to the deepest part of an upper mold half, and the other pole Po corresponds to the deepest part of a lower mold half. The golf ball 2 rotates about the first rotation axis Ax1. This rotation is referred to as PH rotation.

Figure 6:
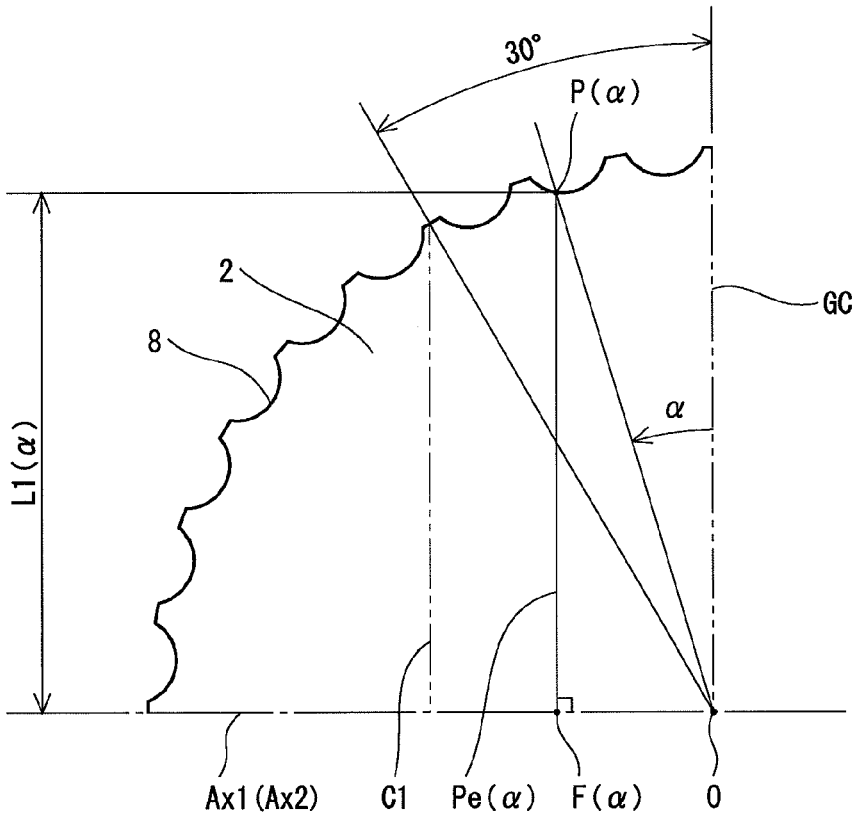
FIG. 6 is a schematic view for explaining the evaluation method in FIG. 5.

There is assumed a great circle GC which exists on the surface of the phantom sphere 12 of the golf ball 2 and is orthogonal to the first rotation axis Ax1. The circumferential speed of the great circle GC is faster than any other part of the golf ball 2 during rotation. In addition, there are assumed two small circles C1 and C2 which exist on the surface of the phantom sphere 12 of the golf ball 2 and are orthogonal to the first rotation axis Ax1. FIG. 6 shows a partial cross-sectional view of the golf ball 2 in FIG. 5. In FIG. 6, the right-to-left direction is the direction of the first rotation axis Ax1. As shown in FIG. 6, the absolute value of the central angle between the small circle C1 and the great circle GC is 30°. Although not shown in the drawing, the absolute value of the central angle between the small circle C2 and the great circle GC is also 30°. The phantom sphere 12 is divided at the small circles C1 and C2, and among the surface of the phantom sphere 12, a region sandwiched between the small circles is defined.

In FIG. 6, a point P(α) is the point which is located on the surface of the golf ball 2 and of which the central angle with the great circle GC is α° (degree). A point F(α) is a foot of a perpendicular line Pe(α) which extends downward from the point P(α) to the first rotation axis Ax1. What is indicated by a arrow L1(α) is the length of the perpendicular line Pe(α). In other words, the length L1(α) is the distance between the point P(α) and the first rotation axis Ax1. For one cross section, the lengths L1(α) are calculated at 21 points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27° and 30°. The 21 lengths L1(α) are summed to obtain a total length L2 (mm). The total length L2 is a parameter dependent on the surface shape in the cross section shown in FIG. 6.

Figure 7:
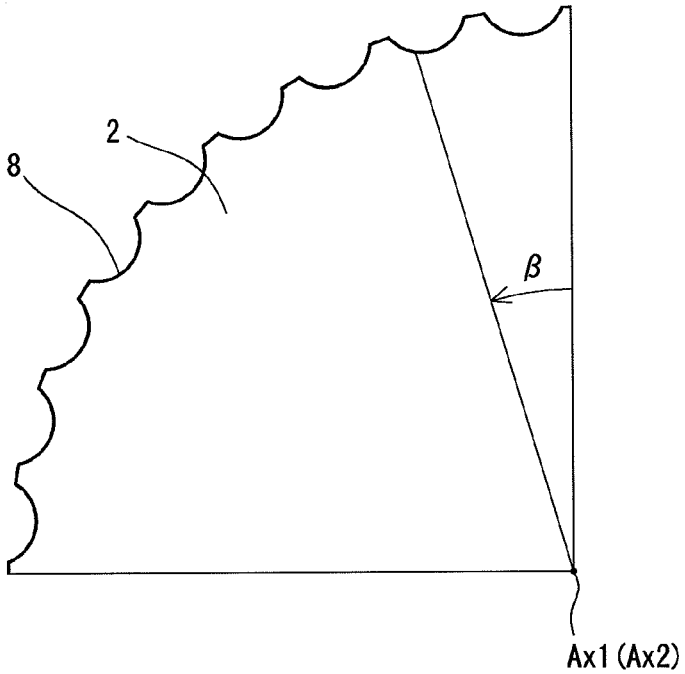
FIG. 7 is a schematic view for explaining the evaluation method in FIG. 5.

FIG. 7 shows a partial cross section of the golf ball 2. In FIG. 7, a direction perpendicular to the surface of the sheet is the direction of the first rotation axis Ax1. In FIG. 7, what is indicated by a reference sign β is a rotation angle of the golf ball 2. In a range equal to or greater than 0° and smaller than 360°, the rotation angles β are set at an interval of an angle of 0.25°. At each rotation angle, the total length L2 is calculated. As a result, 1440 total lengths L2 are obtained along the rotation direction. In other words, a data constellation, regarding a parameter dependent on a surface shape appearing at a predetermined point moment by moment during one rotation of the golf ball 2, is calculated. The data constellation is calculated based on the 30240 lengths L1.

Figure 8:
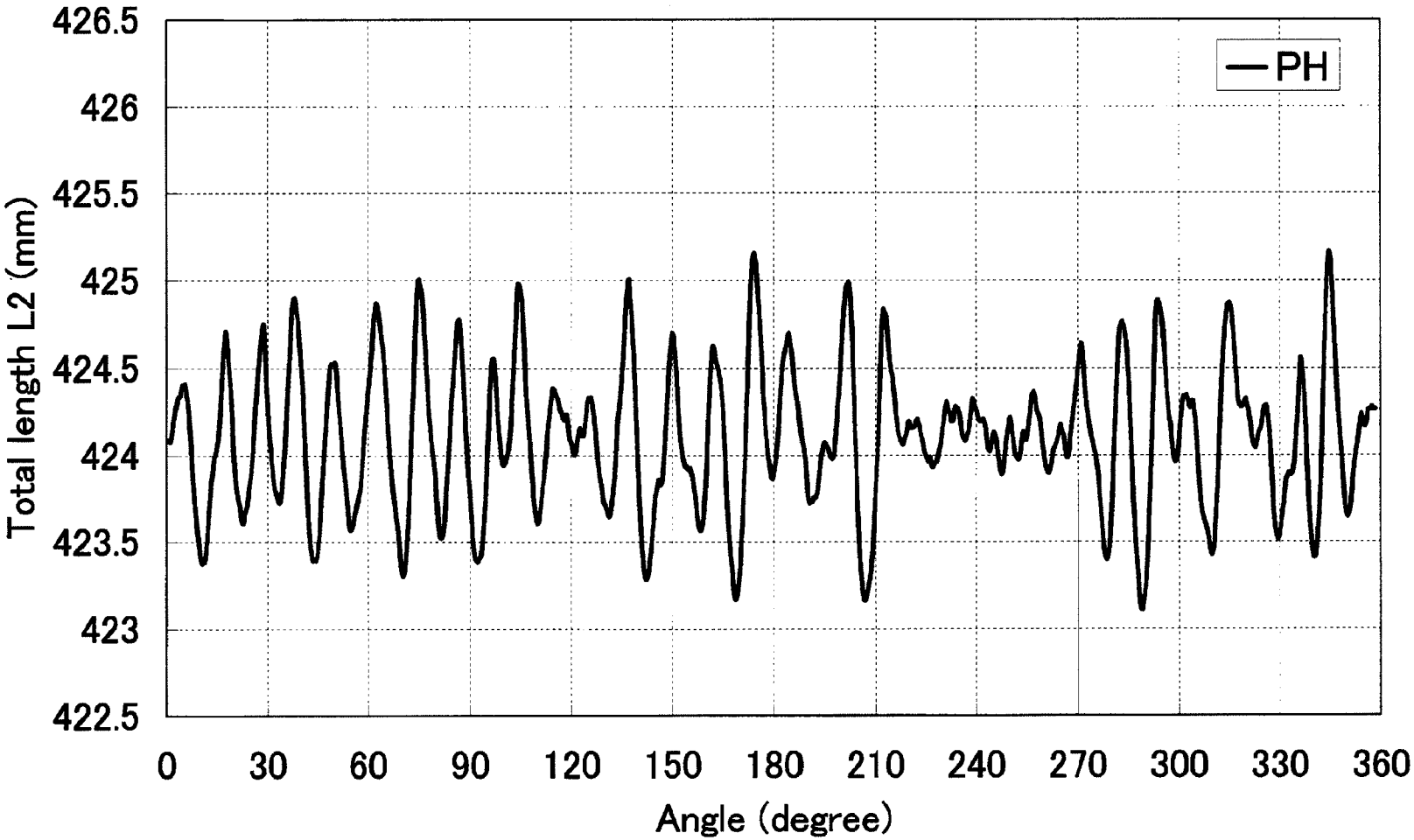
FIG. 8 is a graph showing an evaluation result of the golf ball in FIG. 3.

FIG. 8 shows a graph plotting a data constellation of the golf ball 2 shown in FIGS. 3 and 4. In this graph, the horizontal axis indicates the rotation angle β, and the vertical axis indicates the total length L2. From this graph, the maximum and minimum values of the total length L2 are determined. The minimum value is subtracted from the maximum value to calculate a fluctuation range. The fluctuation range is divided by the total volume ($mm^3$) of the dimples 8 to calculate a value Ad1. The value Ad1 is a numeric value indicating an aerodynamic characteristic at PH rotation.

Figure 9:
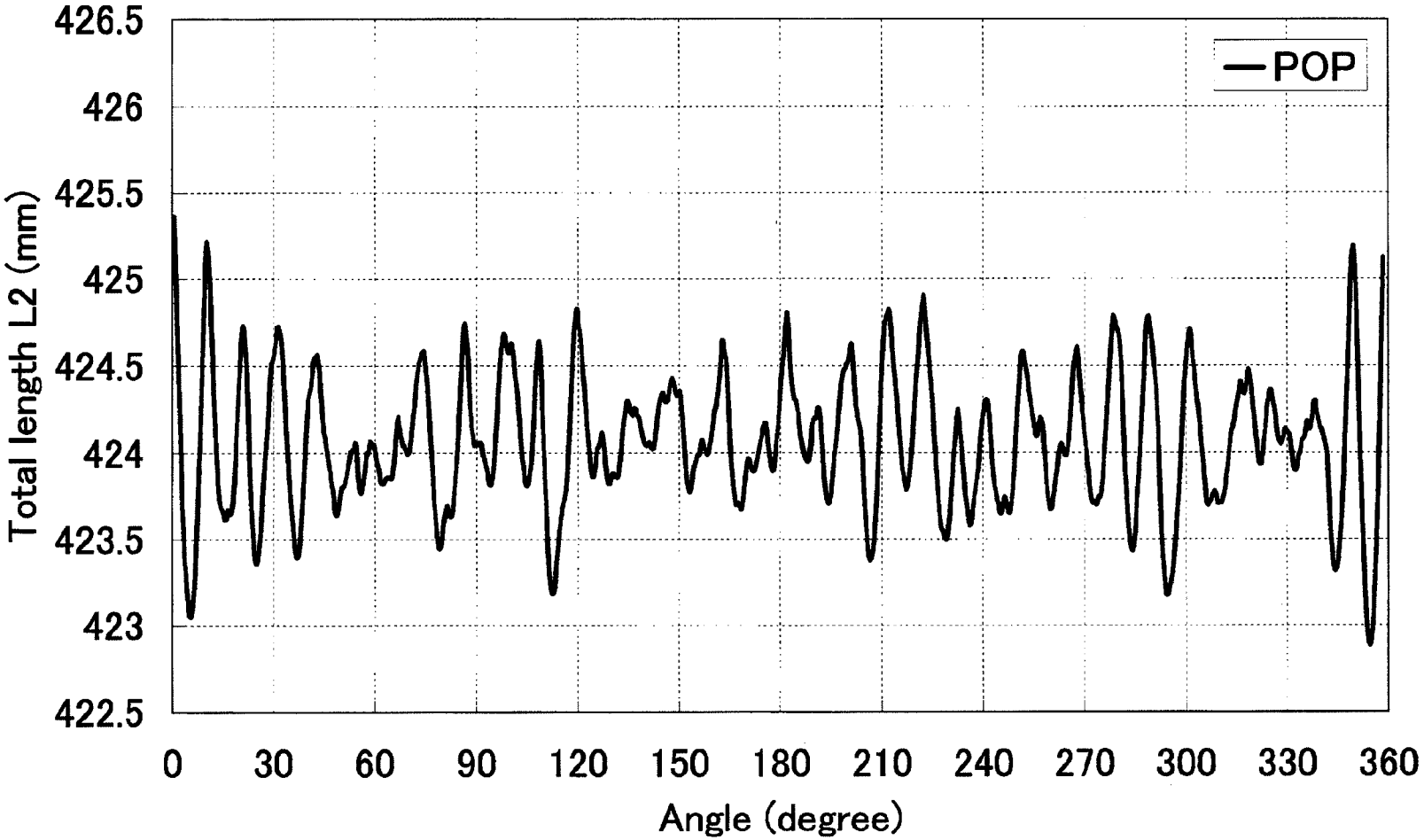
FIG. 9 is a graph showing another evaluation result of the golf ball in FIG. 3.

Further, a second rotation axis Ax2 orthogonal to the first rotation axis Ax1 is determined. Rotation of the golf ball 2 about the second rotation axis Ax2 is referred to as POP rotation. Similarly as for PH rotation, for POP rotation, a great circle GC and two small circles C1 and C2 are assumed. The absolute value of the central angle between the small circle C1 and the great circle GC is 30°. The absolute value of the central angle between the small circle C2 and the great circle GC is also 30°. For a region sandwiched between the small circles among the surface of the phantom sphere 12, 1440 total lengths L2 are calculated. In other words, a data constellation, regarding a parameter dependent on a surface shape appearing at a predetermined point moment by moment during one rotation of the golf ball 2, is calculated. FIG. 9 shows a graph plotting a data constellation of the golf ball 2 shown in FIGS. 3 and 4. In this graph, the horizontal axis indicates the rotation angle β, and the vertical axis indicates the total length L2. From this graph, the maximum and minimum values of the total length L2 are determined. The minimum value is subtracted from the maximum value to calculate a fluctuation range. The fluctuation range is divided by the total volume ($mm^3$) of the dimples 8 to calculate a value Ad2. The value Ad2 is a numeric value indicating an aerodynamic characteristic for POP rotation.

There are numerous straight lines orthogonal to the first rotation axis Ax1. A straight line of which the corresponding great circle GC contains the most number of dimple centers substantially located therein is set as the second rotation axis Ax2. When there are in reality a plurality of straight lines of which the corresponding great circles GC each contain the most number of dimple centers substantially located therein, the fluctuation range is calculated for each of the cases where these straight lines are set as second rotation axis Ax2. The greatest fluctuation range is divided by the total volume of the dimples 8 to obtain a value Ad2.

The following shows a result of the golf ball 2 shown in FIGS. 3 and 4, calculated by the above evaluation method.

Total volume of dimples 8: 325 $mm^3$
PH Rotation
Maximum value of total length L2: 425.16 mm
Minimum value of total length L2: 423.10 mm
Fluctuation range: 2.06 mm
Ad1: 0.0063 $mm^2$
POP Rotation
Maximum value of total length L2: 425.37 mm
Minimum value of total length L2: 422.89 mm
Fluctuation range: 2.48 mm
Ad2: 0.0076 $mm^{-2}$
Absolute value of difference between Ad1 and Ad2: 0.0013

The following Table 6 shows values Ad1 and Ad2 calculated for commercially available golf balls.

TABLE 6

| | Marketed Products | | | | |
|---|---|---|---|---|---|
| | A | B | C | D | E |
| Ad1 ($mm^{-2}$) | 0.00271 | 0.00468 | 0.00241 | 0.00506 | 0.00326 |
| Ad2 ($mm^{-2}$) | 0.01135 | 0.01123 | 0.01324 | 0.01313 | 0.01248 |
| Difference ($mm^{-2}$) | 0.00865 | 0.00656 | 0.01082 | 0.00806 | 0.00923 |
| Ad3 | 0.00216 | 0.00525 | 0.00135 | 0.00484 | 0.00052 |
| Ad4 | 0.01003 | 0.00929 | 0.01100 | 0.00913 | 0.01048 |
| Difference | 0.00787 | 0.00403 | 0.00965 | 0.00429 | 0.00967 |

As is clear from the comparison with the marketed products, the value Ad2 of the golf ball 2 shown in FIGS. 3 and 4 is small. According to the findings by the inventors of the present invention, the golf ball 2 with small values for Ad1 and Ad2 has a long flight distance. The detailed reason is not clear, but it is inferred that this is because transition of turbulent flow continues smoothly.

In light of flight distance, each of the values Ad1 and Ad2 is preferably equal to or less than 0.009 $mm^{-2}$, more preferably equal to or less than 0.008 $mm^{-2}$, much more preferably equal to or less than 0.006 $mm^{-2}$, and particularly preferably 0.004 $mm^{-2}$. The ideal values of Ad1 and Ad2 are zero.

As is clear from the comparison with the marketed products, the difference between the values Ad1 and Ad2 of the golf ball 2 shown in FIGS. 3 and 4 is small. According to the findings by the inventors, the golf ball 2 with a small difference between the values Ad1 and Ad2 has excellent aerodynamic symmetry. It is inferred that this is because the similarity between the surface shape during PH rotation and the surface shape during POP rotation is high and hence the difference between the dimple effect for PH rotation and the dimple effect for POP rotation is small.

In light of aerodynamic symmetry, the absolute value of the difference between the values Ad1 and Ad2 is preferably equal to or less than 0.005 $mm^{-2}$, more preferably equal to or less than 0.003 $mm^{-2}$, much more preferably equal to or less than 0.002 $mm^{-2}$, and particularly preferably equal to or less than 0.001 $mm^{-2}$. The ideal value of the difference is zero.

As described above, the golf ball 2 needs an appropriate total volume of the dimples 8. The fluctuation range of the total length L2 correlates with the total volume of the dimples 8. In a golf ball 2 with a small total volume of the dimples 8, the fluctuation range can be set small. However, even if the fluctuation range is small, the golf ball 2 with an excessively small total volume of the dimples 8 has a short flight distance. In the above evaluation method, the fluctuation range is divided by the total volume to calculate the values Ad1 and Ad2. The values Ad1 and Ad2 are numeric values obtained by taking the fluctuation range and the total volume into account. The golf ball 2 with appropriate values Ad1 and Ad2 has a long flight distance.

The absolute value of the central angle between the great circle GC and the small circle C1 and the absolute value of the central angle between the great circle GC and the small circle C2 can be arbitrarily set in a range equal to or less than 90°. As the absolute value of the central angle becomes smaller, the cost for calculation becomes lower. On the other hand, if the absolute value of the central angle is excessively small, accuracy of evaluation becomes insufficient. During flight of the golf ball 2, the region near the great circle GC receives large pressure from the air. The dimples 8 existing in the region contribute greatly to the dimple effect. In this respect, in the evaluation method, the absolute value of the central angle is set at 30°.

The dimples 8 close to the great circle GC contribute greatly to the dimple effect. On the other hand, the dimples 8 distant from the great circle GC contribute slightly to the dimple effect. In this respect, each of many obtained lengths L1(α) may be multiplied by a coefficient dependent on the angle α to calculate the total length L2. For example, each length L(α) may be multiplied by sin α to calculate the total length L2.

In the evaluation method, based on the angles α set at an interval of an angle of 3°, many lengths L1(α) are calculated. The angles α are not necessarily set at an interval of an angle of 3°. The angles α are preferably set at an interval of an angle equal to or greater than 0.1° and equal to or less than 5°. If the angles α are set at an interval of an angle equal to or greater than 0.1°, the computer load is small. If the angles α are set at an interval of an angle equal to or less than 5°, accuracy of evaluation is high. In light of accuracy, the angles α are set at an interval of an angle more preferably equal to or less than 4° and particularly preferably equal to or less 3°.

In the evaluation method, based on the angles β set at an interval of an angle of 0.25°, many total lengths L2 are calculated. The angles β are not necessarily set at an interval of an angle of 0.25°. The angles β are preferably set at an interval of an angle equal to or greater than 0.1° and equal to or less than 5°. If the angles β are set at an interval of an angle equal to or greater than 0.1°, the computer load is small. If the angles β are set at an interval of an angle equal to or less than 5°, accuracy of evaluation is high. In light of accuracy, the angles β are set at an interval of an angle more preferably equal to or less than 4° and particularly preferably equal to or less 3°. Depending on the position of a point (start point) at which the angle β is first measured, the values Ad1 and Ad2 change. However, because the change range is negligibly small, the start point can be arbitrarily set.

In the evaluation method, the data constellation is calculated based on the length L1(α). The length L1(α) is a parameter dependent on the distance between the rotation axis (Ax1 or Ax2) and the surface of the golf ball 2. Another parameter dependent on the surface shape of the golf ball 2 may be used. Examples of other parameters include:

(a) Distance between the surface of the phantom sphere 12 and the surface of the golf ball 2; and (b) Distance between the surface and the center O (see FIG. 6) of the golf ball 2.

The golf ball 2 may be evaluated only based on a first data constellation obtained by rotation about the first rotation axis Ax1. The golf ball 2 may be evaluated only based on a second data constellation obtained by rotation about the second rotation axis Ax2. Preferably, the golf ball 2 is evaluated based on both the first data constellation and the second data constellation. Preferably, the aerodynamic symmetry of the golf ball 2 is evaluated by the comparison of the first data constellation and the second data constellation.

A data constellation may be obtained based on an axis other than the first rotation axis Ax1 and the second rotation axis Ax2. The positions and the number of rotation axes can be arbitrarily set. Preferably, based on two rotation axes, two data constellations are obtained. Evaluation based on two data constellations is superior in accuracy to that based on one data constellation. The evaluation based on two data constellations can be done in a shorter time than that based on three or more data constellations. When evaluation based on two data constellations is done, two rotation axes may not be orthogonal to each other.

As a result of thorough research by the inventors of the present invention, it is confirmed that when evaluation is done based on both PH rotation and POP rotation, the result has a high correlation with the flight performance of the golf ball. The reason is predicated as follow:

(a) The region near the seam is a unique region and PH rotation is most affected by this region;

(b) POP rotation is unlikely to be affected by this region; and (c) By the evaluation based on both PH rotation and POP rotation, an objective result is obtained.

The evaluation based on both PH rotation and POP rotation is preferable from the standpoint that conformity to the rules established by the USGA can be determined.

In a designing process according to the present invention, the positions of numerous dimples located on the surface of the golf ball 2 are determined. Specifically, the latitude and longitude of each dimple 8 are determined. In addition, the shape of each dimple 8 is determined. This shape includes diameter, depth, curvature radius of a cross section and the like. The aerodynamic characteristic of the golf ball 2 is evaluated by the above method. For example, the above values Ad1 and Ad2 are calculated, and their magnitudes are evaluated. Further, the difference between the values Ad1 and Ad2 is evaluated. If the aerodynamic characteristic is insufficient, the positions and the shapes of the dimples 8 are changed. After the change, evaluation is done again. In this designing process, the golf ball 2 can be evaluated without producing a mold.

The following will describe another evaluation method according to the present invention. In the evaluation method, similarly as in the aforementioned evaluation method, a first rotation axis Ax1 (see FIG. 5) is assumed. The first rotation axis Ax1 passes through the two poles Po of the golf ball 2. The golf ball 2 rotates about the first rotation axis Ax1. This rotation is referred to as PH rotation. In addition, a great circle GC, a small circle C1, and a small circle C2 which are orthogonal to the first rotation axis Ax1 are assumed. The absolute value of the central angle between the small circle C1 and the great circle GC is 30°. The absolute value of the central angle between the small circle C2 and the great circle GC is also 30°. The above phantom sphere 12 is divided at the small circles C1 and C2, and among the phantom sphere 12, a region sandwiched between the small circles is defined.

Figure 10:
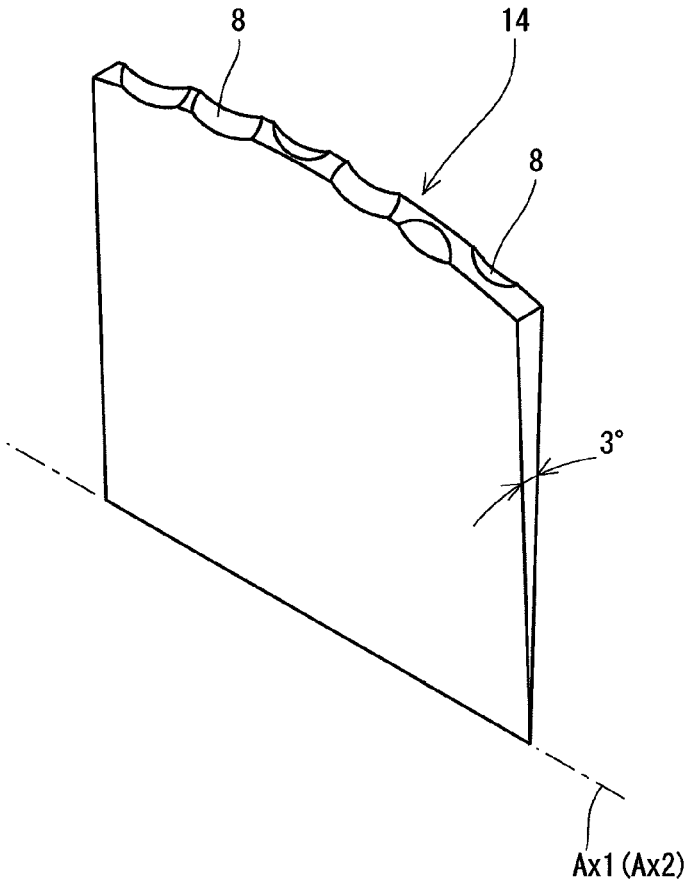
FIG. 10 is a schematic view for explaining an evaluation method according to an alternative embodiment of the present invention.
Figure 11:
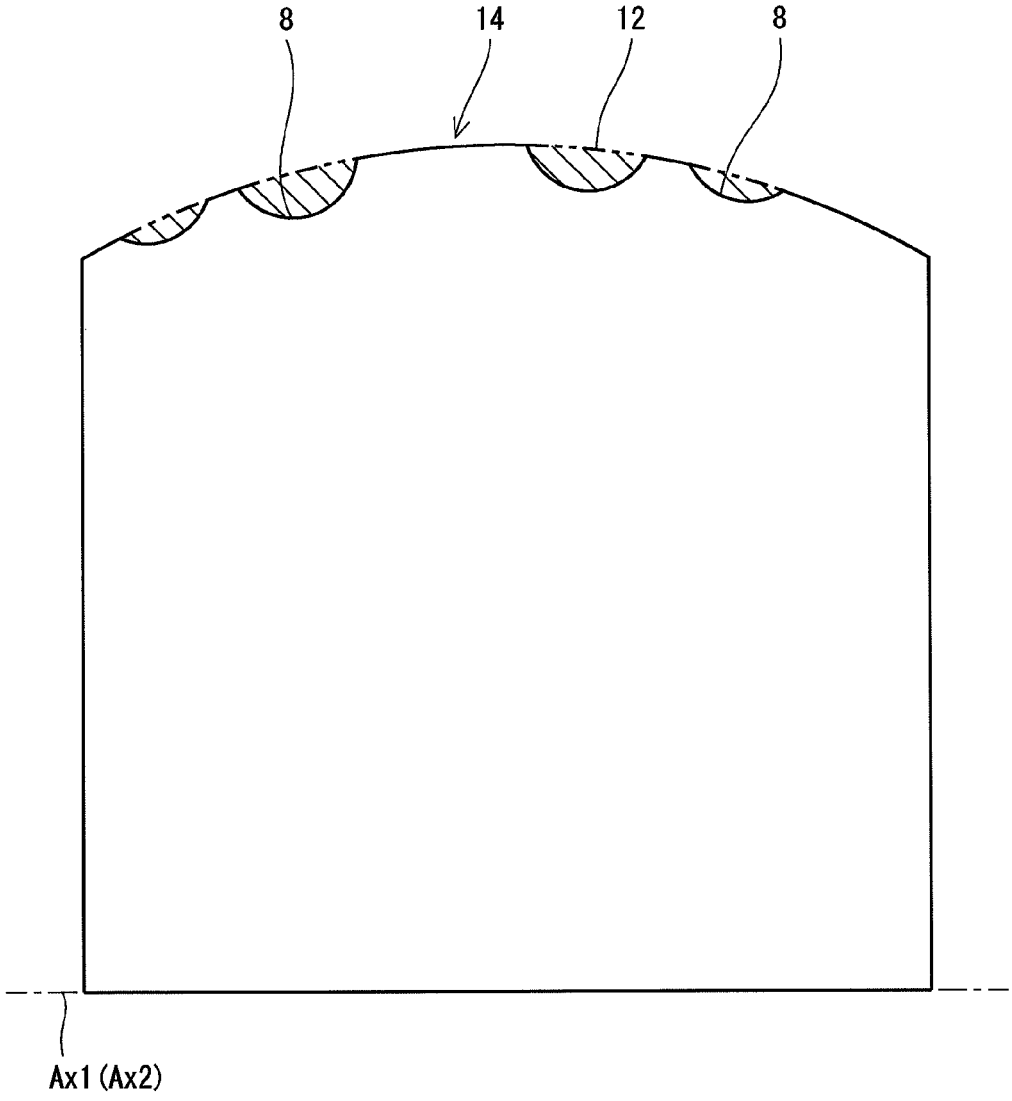
FIG. 11 is a schematic view for explaining the evaluation method in FIG. 10.

This region is divided at an interval of a central angle of 3° in the rotation direction into 120 minute regions. FIG. 10 shows one minute region 14. FIG. 11 is an enlarged cross-sectional view of the minute region 14 in FIG. 10. For the minute region 14, the volume of spaces between the surface of the phantom sphere 12 and the surface of the golf ball 2 are calculated. This volume is the volume of parts hatched in FIG. 11. The volume is calculated for each of the 120 minute regions 14. In other words, 120 volumes along the rotation direction when the golf ball 2 makes one rotation are calculated. These volumes are a data constellation regarding a parameter dependent on a surface shape appearing at a predetermined point moment by moment during one rotation of the golf ball 2.

Figure 12:
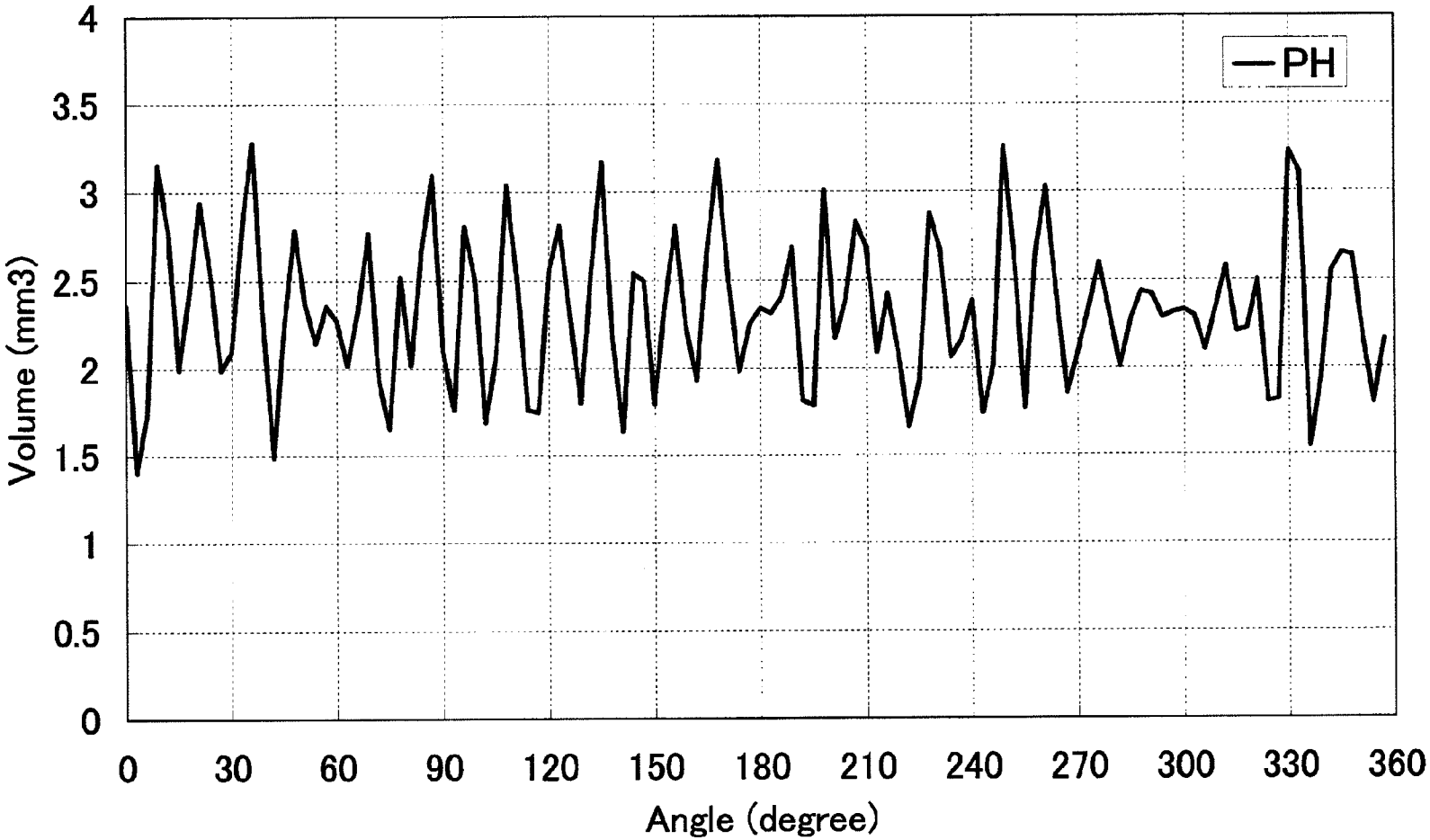
FIG. 12 is a graph showing an evaluation result of the golf ball in FIG. 3.

FIG. 12 shows a graph plotting a data constellation of the golf ball 2 shown in FIGS. 3 and 4. In this graph, the horizontal axis indicates the angle in the rotation direction, and the vertical axis indicates the volume for the minute region. From this graph, the maximum value and the minimum value of the volume are determined. The minimum value is subtracted from the maximum value to calculate a fluctuation range. The fluctuation range is divided by the total volume ($mm^3$) of the dimples 8 to calculate a value Ad3. The value Ad3 is a numeric value indicating an aerodynamic characteristic at PH rotation.

Figure 13:
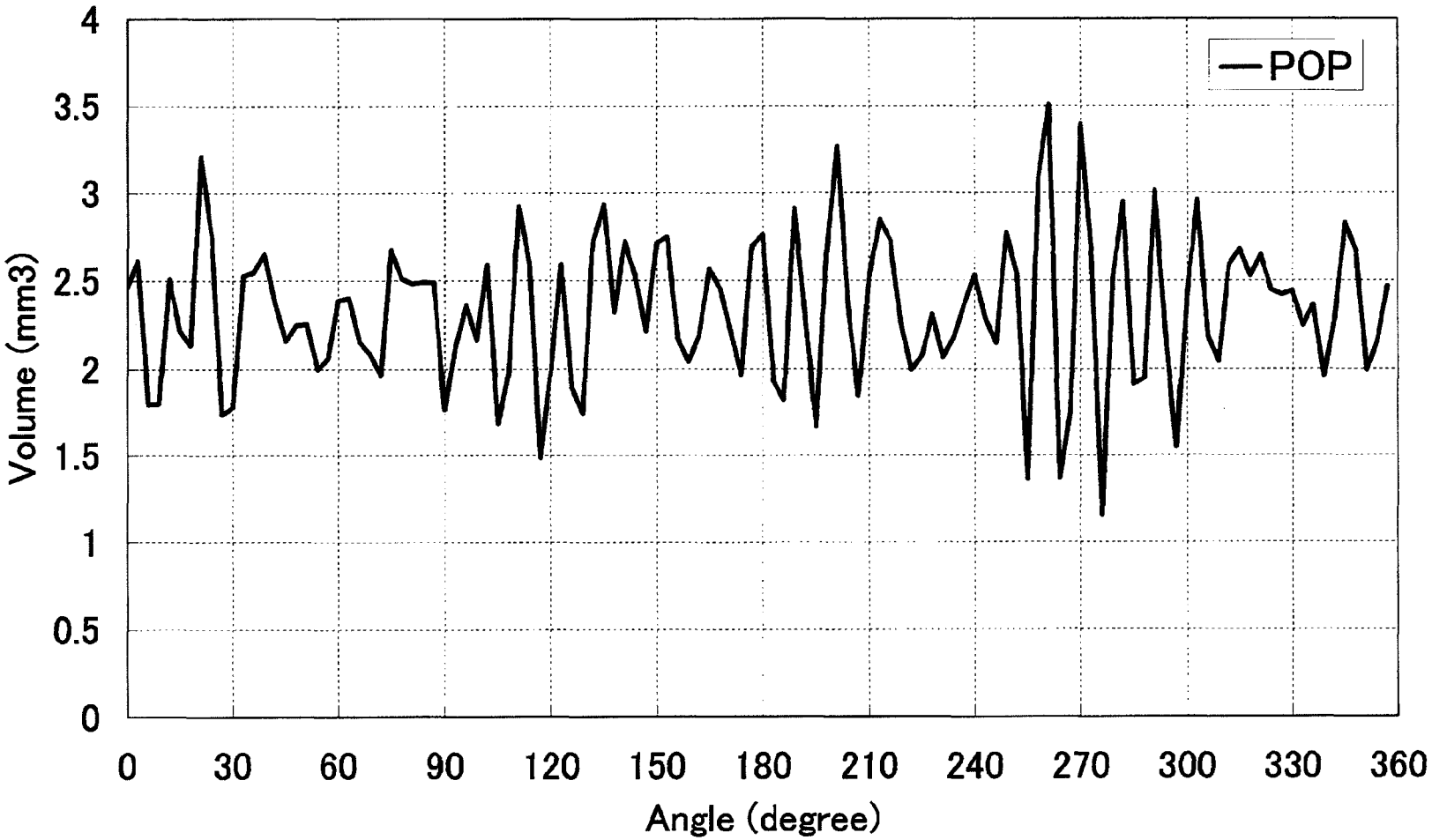
FIG. 13 is a graph showing another evaluation result of the golf ball in FIG. 3.

Further, a second rotation axis Ax2 orthogonal to the first rotation axis Ax1 is determined. The rotation of the golf ball 2 about the second rotation axis Ax2 is referred to as POP rotation. For POP rotation, similarly as for PH rotation, a great circle GC and two small circles C1 and C2 are assumed. The absolute value of the central angle between the small circle C1 and the great circle GC is 30°. The absolute value of the central angle between the small circle C2 and the great circle GC is also 30°. Among the phantom sphere 12, a region sandwiched between these small circles is divided at an interval of a central angle of 3° in the rotation direction into 120 minute regions 14. For each minute region 14, the volume of spaces between the surface of the phantom sphere 12 and the surface of the golf ball 2 is calculated. FIG. 13 shows a graph plotting a data constellation of the golf ball 2 shown in FIGS. 3 and 4. In this graph, the horizontal axis indicates the angle in the rotation direction, and the vertical axis indicates the volume for the minute region. From this graph, the maximum and minimum values of the volume are determined. The minimum value is subtracted from the maximum value to calculate a fluctuation range. The fluctuation range is divided by the total volume of the dimples 8 to calculate a value Ad4. The value Ad4 is a numeric value indicating an aerodynamic characteristic for POP rotation.

There are numerous straight lines orthogonal to the first rotation axis Ax1. A straight line of which the corresponding great circle GC contains the most number of dimple centers substantially located therein is set as the second rotation axis Ax2. When there are in reality a plurality of straight lines of which the corresponding great circles GC each contain the most number of dimple centers substantially located therein, the fluctuation range is calculated for each of the cases where these straight lines are set as second rotation axis Ax2. The greatest fluctuation range is divided by the total volume of the dimples 8 to obtain a value Ad4.

The following shows a result of, the golf ball 2 shown in FIGS. 3 and 4, calculated by the above evaluation method.

Total volume of dimples 8: 325 $mm^3$

PH Rotation

Maximum value of volume for minute region 14: 3.281 $mm^3$

Minimum value of volume for minute region 14: 1.396 $mm^3$

Fluctuation range: 1.885 $mm^3$

Ad3: 0.0058

POP Rotation

Maximum value of volume for minute region 14: 3.511 $mm^3$

Minimum value of volume for minute region 14: 1.171 $mm^3$

Fluctuation range: 2.340 $mm^3$

Ad4: 0.0072

Absolute value of difference between Ad3 and Ad4: 0.0014

The above Table 6 also shows values Ad3 and Ad4 calculated for the commercially available golf balls.

As is clear from the comparison with the marketed products, the value Ad4 of the golf ball 2 shown in FIGS. 3 and 4 is small. According to the findings by the inventors of the present invention, the golf ball 2 with small values for Ad3 and Ad4 has a long flight distance. The detailed reason is not clear, but it is inferred that this is because transition of turbulent flow continues smoothly.

In light of flight distance, each of the values Ad3 and Ad4 is preferably equal to or less than 0.008, more preferably equal to or less than 0.007, much more preferably equal to or less than 0.006, and particularly preferably 0.005. The ideal values of Ad3 and Ad4 are zero.

As is clear from the comparison with the marketed products, the difference between the values Ad3 and Ad4 of the golf ball 2 shown in FIGS. 3 and 4 is small. According to the findings by the inventors, the golf ball 2 with a small difference between values Ad3 and Ad4 has excellent aerodynamic symmetry. It is inferred that this is because the difference between the dimple effect for PH rotation and the dimple effect for POP rotation is small.

In light of aerodynamic symmetry, the absolute value of the difference between the values Ad3 and Ad4 is preferably equal to or less than 0.003, more preferably equal to or less than 0.002, and particularly preferably equal to or less than 0.001. The ideal value of the difference is zero.

As described above, the golf ball 2 needs an appropriate total volume of the dimples 8. The fluctuation range of the volume for the minute region 14 correlates with the total volume of the dimples 8. In a golf ball 2 with a small total volume of the dimples 8, the fluctuation range can be set small. However, even if the fluctuation range is small, the golf ball 2 with an excessively small total volume of the dimples 8 has a short flight distance. In the above evaluation method, the fluctuation range is divided by the total volume of the dimples 8 to calculate the values Ad3 and Ad4. The values Ad3 and Ad4 are numeric values obtained by taking the fluctuation range and the total volume of the dimples 8 into account. The golf ball 2 with appropriate values Ad3 and Ad4 has a long flight distance.

The absolute value of the central angle between the great circle GC and the small circle C1 and the absolute value of the central angle between the great circle GC and the small circle C2 can be arbitrarily set in a range equal to or less than 90°. As the absolute value of the central angle becomes smaller, the cost for calculation becomes lower. On the other hand, if the absolute value of the central angle is excessively small, accuracy of evaluation becomes insufficient. During flight of the golf ball 2, the region near the great circle GC receives large pressure from the air. The dimples 8 existing in the region contribute greatly to the dimple effect. In this respect, in the evaluation method, the absolute value of the central angle is set at 30°.

In the evaluation method, the region is divided at an interval of a central angle of 3° in the rotation direction into the 120 minute regions 14. The region is not necessarily divided at an interval of a central angle of 3° in the rotation direction. The region is divided at an interval of a central angle preferably equal to or greater than 0.1° and equal to or less than 5°. If the region is divided at an interval of a central angle equal to or greater than 0.1°, the computer load is small. If the region is divided at an interval of a central angle equal to or less than 5°, accuracy of evaluation is high. In light of accuracy, the region is divided at an interval of a central angle preferably equal to or less than 4° and particularly equal to or less than 3°. Depending on the position of a point (start point) at which the central angle is first measured, the values Ad3 and Ad4 change. However, because the change range is negligibly small, the start point can be arbitrarily set.

In the evaluation method, the data constellation is calculated based on the volumes for the minute regions 14. Another parameter dependent on the surface shape of the golf ball 2 may be used. Examples of other parameters include:

(a) Volume of the minute region 14 in the golf ball 2;

(b) Volume of an area of between a plan including the edge of each dimple 8 and the surface of the golf ball 2 in the minute region 14;

(c) Area between the surface of the phantom sphere 12 and the surface of the golf ball 2 in front view of the minute region 14;

(d) Area between a plan including the edge of each dimple 8 and the surface of the golf ball 2 in front view of the minute region 14; and (e) Area of the golf ball 2 in front view of the minute region 14.

The golf ball 2 may be evaluated only based on a first data constellation obtained by rotation about the first rotation axis Ax1. The golf ball 2 may be evaluated only based on a second data constellation obtained by rotation about the second rotation axis Ax1. Preferably, the golf ball 2 is evaluated based on both the first data constellation and the second data constellation. Preferably, the aerodynamic symmetry of the golf ball 2 is evaluated by the comparison of the first data constellation and the second data constellation.

A data constellation may be obtained based on an axis other than the first rotation axis Ax1 and the second rotation axis Ax1. The positions and the number of rotation axes can be arbitrarily set. Preferably, based on two rotation axes, two data constellations are obtained. Evaluation based on two data constellations is superior in accuracy to that based on one data constellation. The evaluation based on two data constellations can be done in a shorter time than that based on three or more data constellations. When evaluation based on two data constellations is done, two rotation axes may not be orthogonal to each other.

As a result of thorough research by the inventors of the present invention, it is confirmed that when evaluation is done based on both PH rotation and POP rotation, the result has a high correlation with the flight performance of the golf ball. The reason is predicated as follow:

(a) The region near the seam is a unique region and PH rotation is most affected by this region;

(b) POP rotation is unlikely to be affected by this region; and (c) By the evaluation based on both PH rotation and POP rotation, an objective result is obtained.

The evaluation based on both PH rotation and POP rotation is preferable from the standpoint that conformity to the rules established by the USGA can be determined.

In a designing process according to the present invention, the positions of numerous dimples located on the surface of the golf ball 2 are determined. Specifically, the latitude and longitude of each dimple 8 are determined. In addition, the shape of each dimple 8 is determined. This shape includes diameter, depth, curvature radius of a cross section and the like. The aerodynamic characteristic of the golf ball 2 is evaluated by the above method. For example, the above values Ad3 and Ad4 are calculated, and their magnitudes are evaluated. Further, the difference between the values Ad3 and Ad4 is evaluated. If the aerodynamic characteristic is insufficient, the positions and the shapes of the dimples 8 are changed. After the change, evaluation is done again. In this designing process, the golf ball 2 can be evaluated without producing a mold.

EXAMPLES

Example

A rubber composition was obtained by kneading 100 parts by weight of polybutadiene (trade name "BR-730", available from JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold having upper and lower mold halves each having a hemispherical cavity, and heated at 170° C. for 18 minutes to obtain a core with a diameter of 39.7 mm. Meanwhile, a resin composition was obtained by kneading 50 parts by weight of ionomer resin (trade name "Himilan 1605", available from Du Pont-MITSUI POLYCHEMICALS Co., LTD.), 50 parts by weight of another ionomer resin (Trade name "Himilan 1706", available from Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding to form a cover with a thickness of 1.5 mm. Numerous dimples having a shape inverted from the shape of the pimples were formed on the cover. A clear paint including a two-component curing type polyurethane as a base was applied on this cover to obtain a golf ball of Example having a diameter of 42.7 mm and a weight of about 45.4 g. The golf ball has a PGA compression of about 85. The golf ball has the dimple pattern shown in FIGS. 3 and 4. The detailed specifications of the dimples are shown in the following Table 7.

Comparative Example

Figure 14:
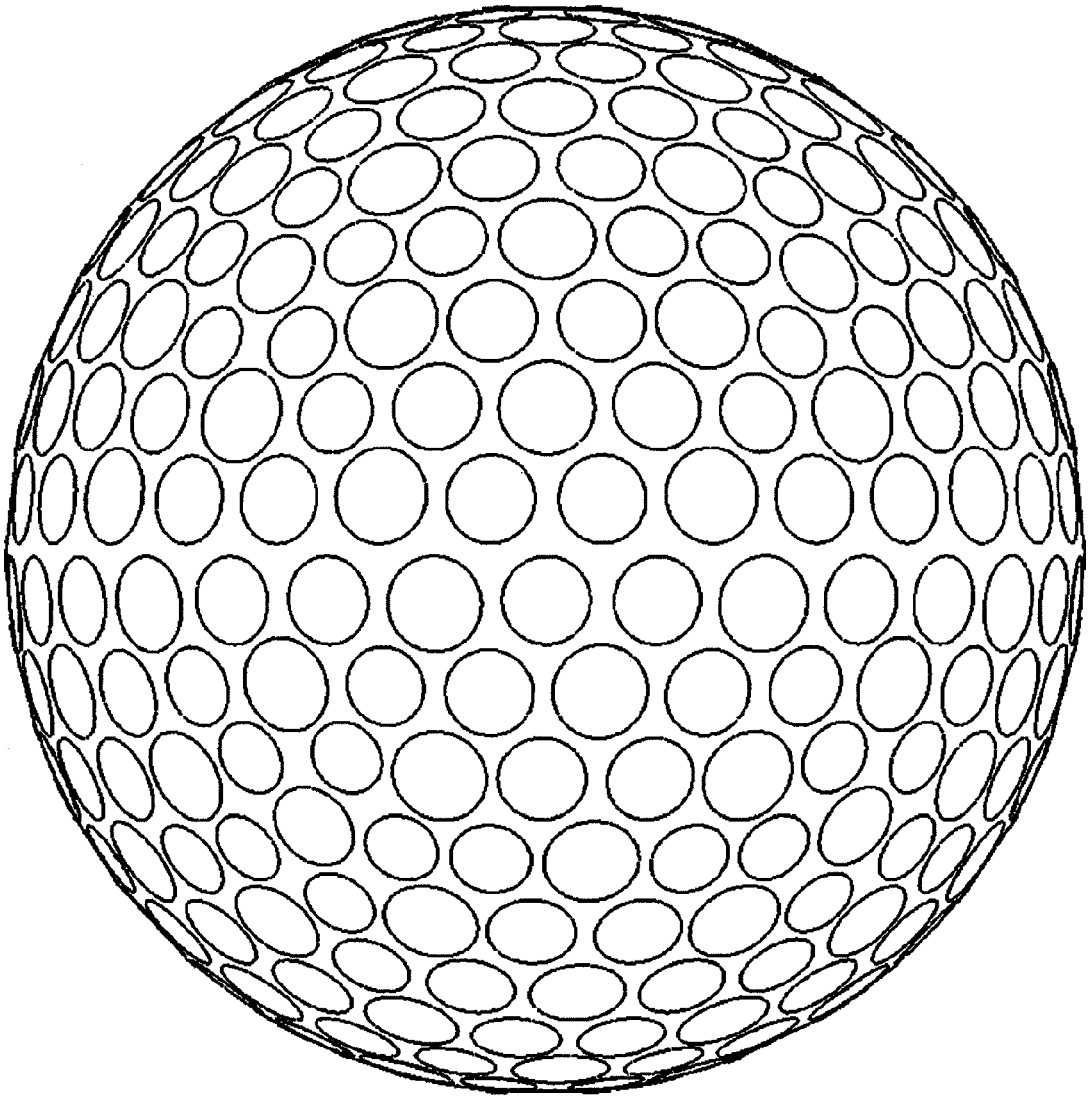
FIG. 14 is a front view of a golf ball according to a comparative example.
Figure 15:
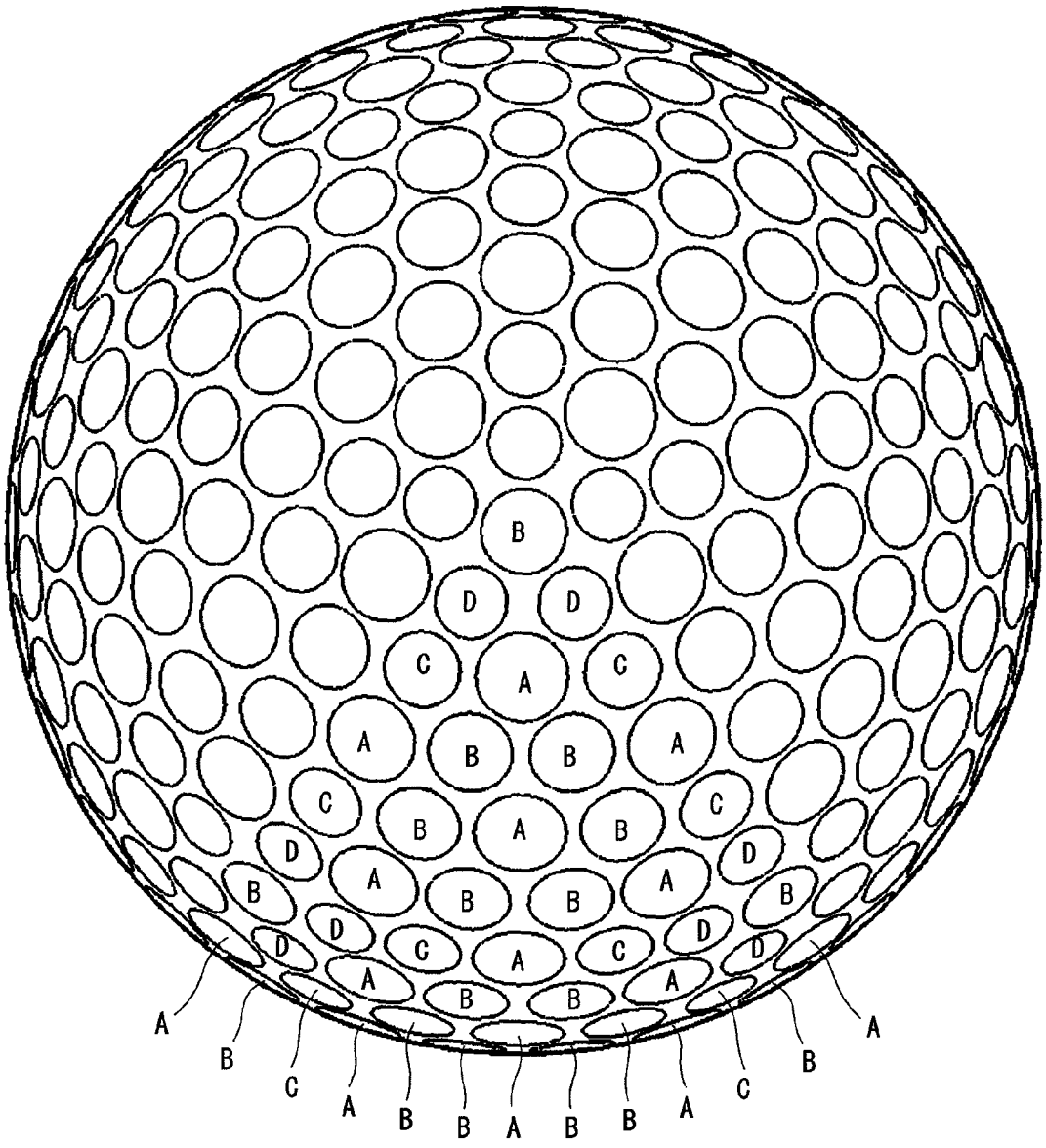
FIG. 15 is a plan view of the golf ball in FIG. 14.

A golf ball of Comparative Example was obtained in the same manner as in Example except that the final mold was changed so as to form dimples whose specifications are shown in the following Table 7. FIG. 14 is a front view of the golf ball of Comparative Example, and FIG. 15 is a plan view of the golf ball. For one unit when northern hemisphere of the golf ball is divided into 5 units, the latitude and longitude of the dimples are shown in the following Table 8. The dimple pattern of this unit is developed to obtain the dimple pattern of the northern hemisphere. The dimple pattern of the southern hemisphere is equivalent to the dimple pattern of the northern hemisphere. The dimple patterns of the northern hemisphere and the southern hemisphere are shifted from each other by 5.98° in the latitude direction. The dimple pattern of the southern hemisphere is obtained by symmetrically moving the dimple pattern of the northern hemisphere relative to the equator after shifting the dimple pattern of the northern hemisphere by 5.98° in the longitude direction. The following shows the result of this golf ball calculated by the above evaluation method.

Total volume of dimples: 320 $mm^3$
PH Rotation
Maximum value of total length L2: 424.71 mm
Minimum value of total length L2: 424.20 mm
Fluctuation range of total length L2: 0.51 mm
Ad1: 0.0016 $mm^{-2}$
Maximum value of volume for minute region: 2.024 $mm^3$
Minimum value of volume for minute region: 1.576 $mm^3$
Fluctuation range of volume: 0.448 $mm^3$ Ad3: 0.0014
POP Rotation
Maximum value of total length L2: 426.15 mm
Minimum value of total length L2: 422.95 mm
Fluctuation range of total length L2: 3.20 mm
Ad2: 0.0100 $mm^{-2}$
Maximum value of volume for minute region: 2.784 $mm^3$
Minimum value of volume for minute region: 0.527 $mm^3$
Fluctuation range of volume: 2.784 $mm^3$
Ad4: 0.0087
Absolute value of difference between Ad1 and Ad2: 0.0084 $mm^{-2}$
Absolute value of difference between Ad3 and Ad4: 0.0073

TABLE 7

Specifications of Dimples

| | Kind | Number | Diameter (mm) | Depth (mm) | Volume ($mm^3$) |
|---|---|---|---|---|---|
| Example | A | 216 | 4.20 | 0.1436 | 0.971 |
| | B | 84 | 3.80 | 0.1436 | 0.881 |
| | C | 72 | 3.00 | 0.1436 | 0.507 |
| | D | 12 | 2.60 | 0.1436 | 0.389 |
| Comparative Example | A | 120 | 3.80 | 0.1711 | 0.973 |
| | B | 152 | 3.50 | 0.1711 | 0.826 |
| | C | 60 | 3.20 | 0.1711 | 0.691 |
| | D | 60 | 3.00 | 0.1711 | 0.607 |

TABLE 8

Dimple Arrangement of Comparative Example

| | Kind | Latitude (degree) | Longitude (degree) |
|---|---|---|---|
| 1 | A | 73.693 | 0.000 |
| 2 | A | 60.298 | 36.000 |
| 3 | A | 54.703 | 0.000 |
| 4 | A | 43.128 | 22.848 |
| 5 | A | 34.960 | 0.000 |
| 6 | A | 24.656 | 18.496 |
| 7 | A | 15.217 | 0.000 |
| 8 | A | 14.425 | 36.000 |
| 9 | A | 5.763 | 18.001 |
| 10 | B | 90.000 | 0.000 |
| 11 | B | 64.134 | 13.025 |
| 12 | B | 53.502 | 19.337 |
| 13 | B | 44.629 | 8.044 |
| 14 | B | 30.596 | 36.000 |
| 15 | B | 24.989 | 6.413 |
| 16 | B | 15.335 | 12.237 |
| 17 | B | 5.360 | 5.980 |
| 18 | B | 5.360 | 30.020 |
| 19 | C | 70.742 | 36.000 |
| 20 | C | 49.854 | 36.000 |
| 21 | C | 34.619 | 13.049 |
| 22 | C | 14.610 | 23.917 |
| 23 | D | 80.183 | 36.000 |
| 24 | D | 40.412 | 36.000 |
| 25 | D | 33.211 | 24.550 |
| 26 | D | 22.523 | 29.546 |

[Flight Distance Test]

A driver with a titanium head (Trade name "XXIO", available from SRI Sports Limited, shaft hardness: R, loft angle: 12°) was attached to a swing machine available from True Temper Co. Then, the golf ball was hit under the conditions of a head speed of 40 m/sec, a launch angle of about 13°, and a backspin rotation speed of about 2500 rpm, and the carry and total distances were measured. At the test, the weather was almost calm. The measurement was done 20 times for each of PH rotation and POP rotation, and the average values of the results are shown in the following Table 9.

TABLE 9

Results of Evaluation

Figure 16:
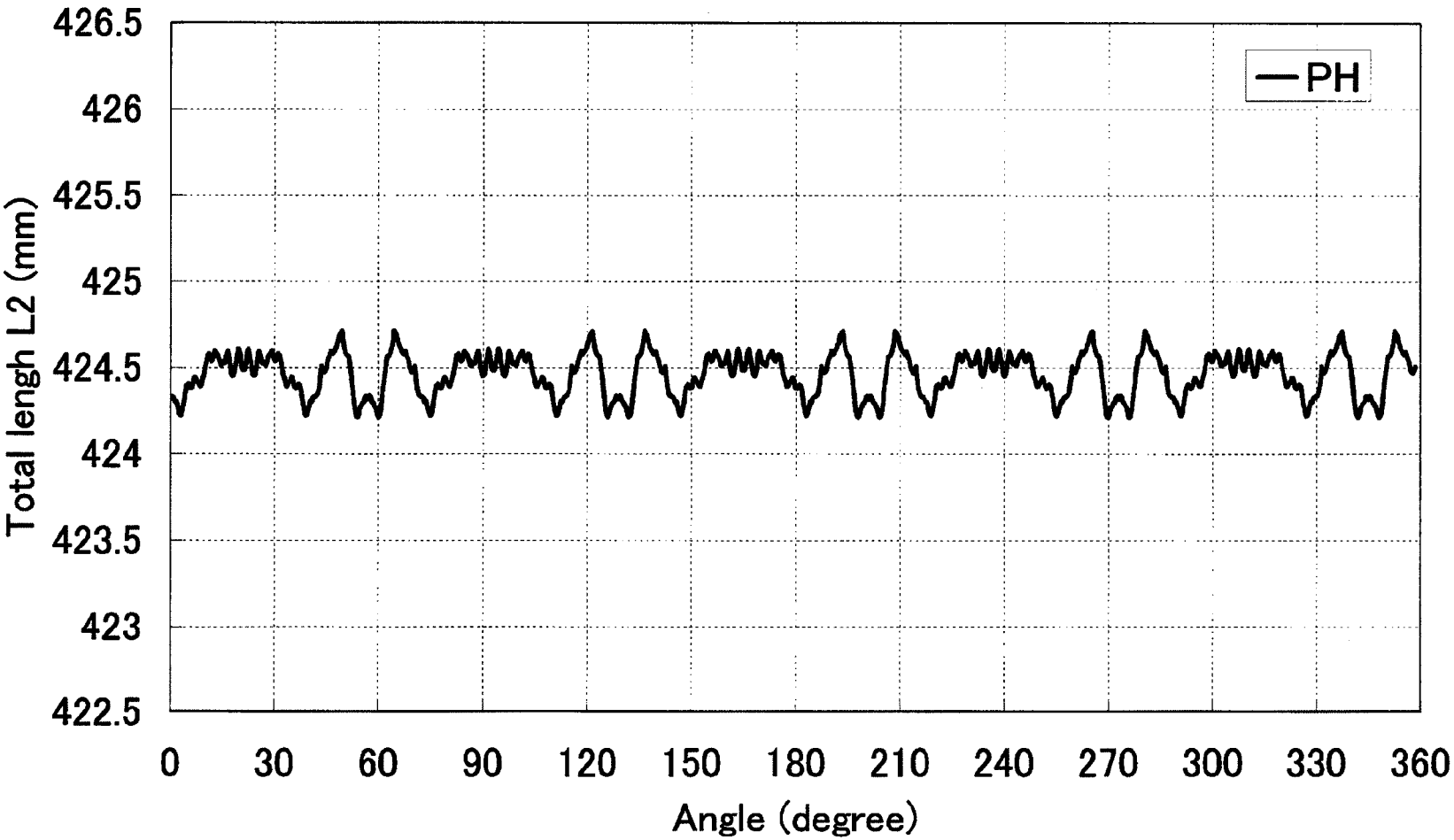
FIG. 16 is a graph showing an evaluation result of the golf ball in FIG. 14.
Figure 17:
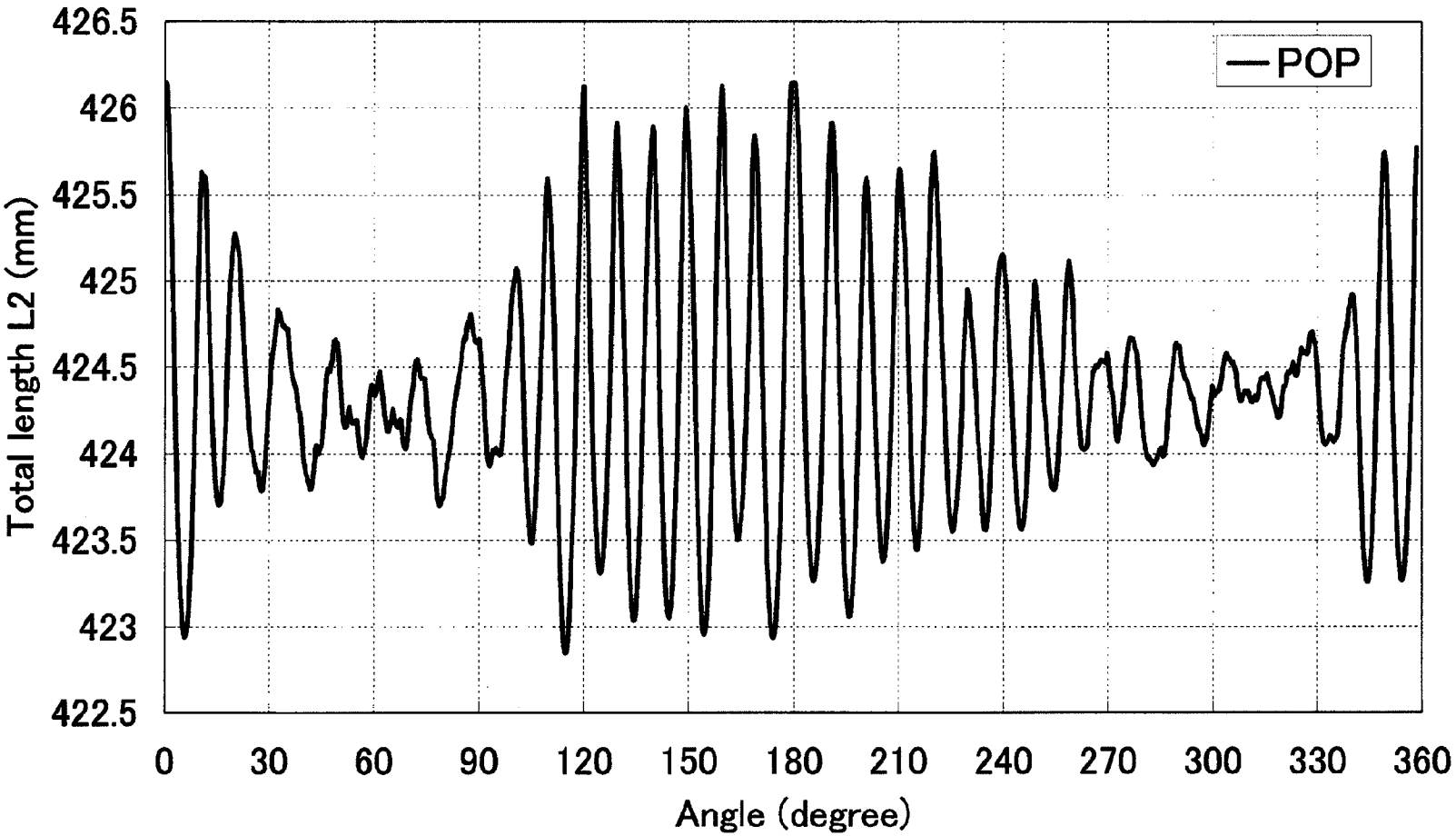
FIG. 17 is a graph showing another evaluation result of the golf ball in FIG. 14.
Figure 18:
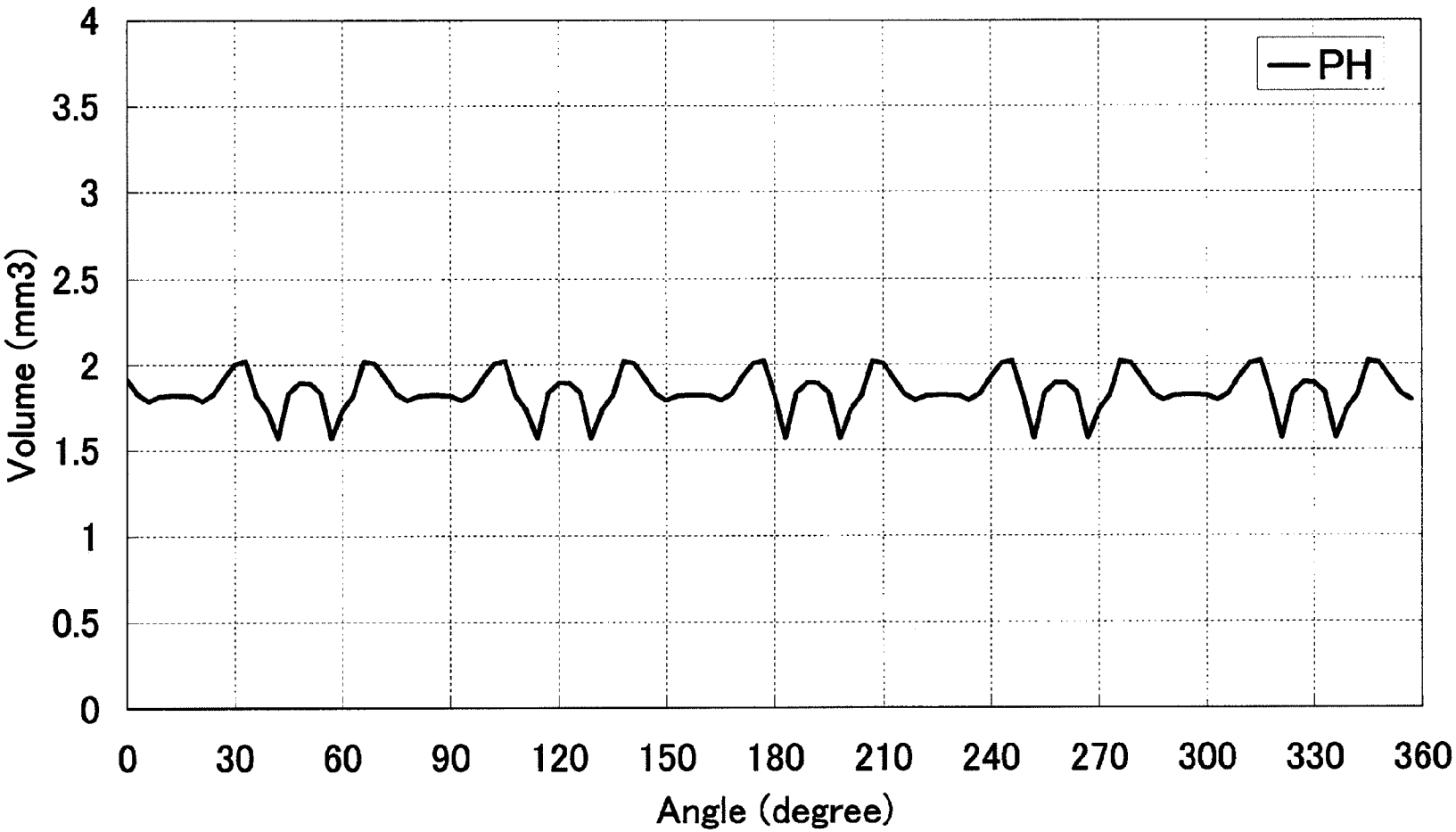
FIG. 18 is a graph showing another evaluation result of the golf ball in FIG. 14.
Figure 19:
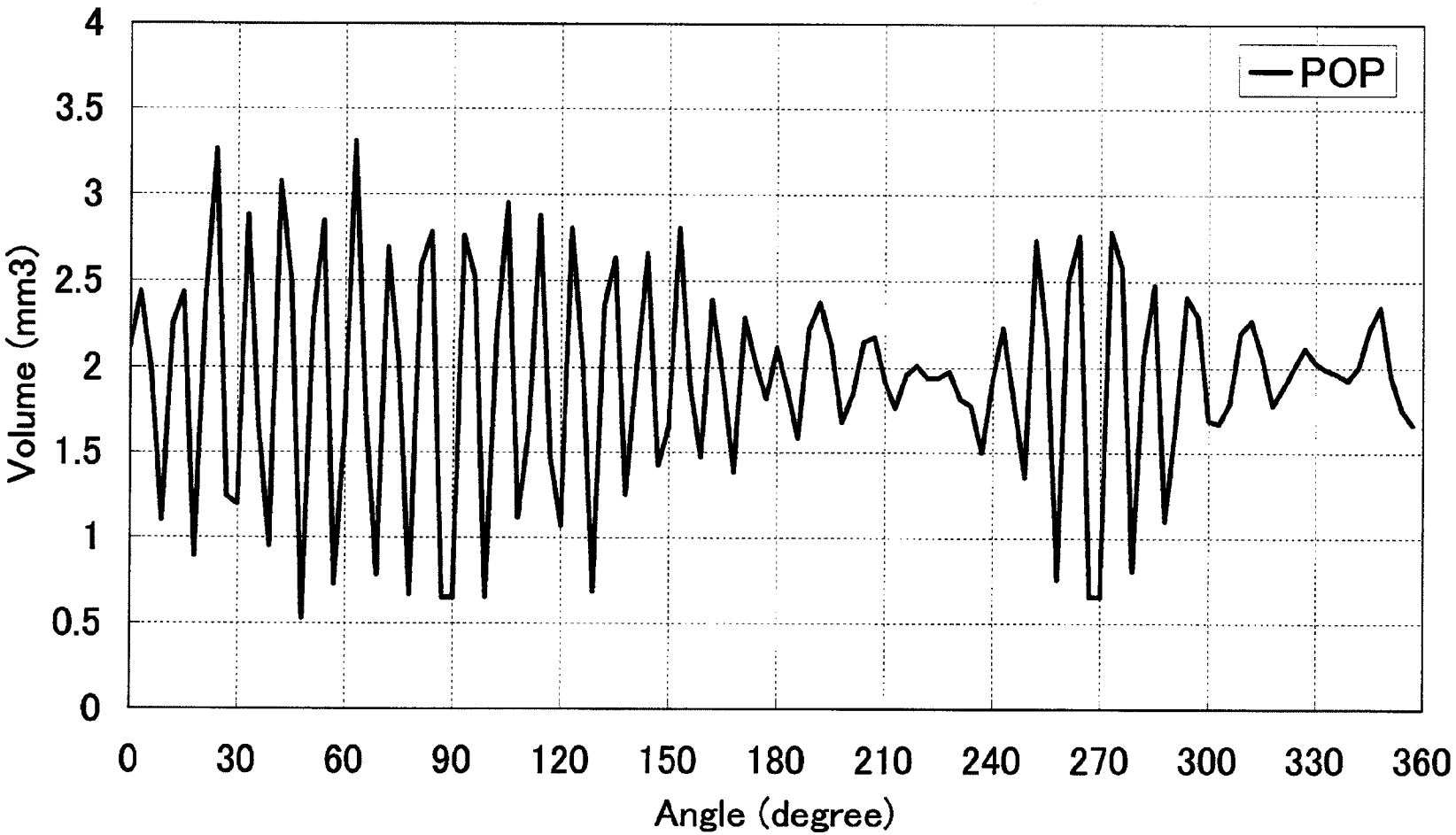
FIG. 19 is a graph showing another evaluation result of the golf ball in FIG. 14.

| | | Example | Comparative Example |
|---|---|---|---|
| Front view | | FIG. 3 | FIG. 14 |
| Plan view | | FIG. 4 | FIG. 15 |
| Total number | | 384 | 392 |
| Total volume ($mm^3$) | | 325 | 320 |
| Occupation ratio (%) | | 79 | 65.2 |
| Graph of L2 (PH rotation) | | FIG. 8 | FIG. 16 |
| Graph of L2 (POP rotation) | | FIG. 9 | FIG. 17 |
| Ad1 ($mm^{-2}$) | | 0.0063 | 0.0016 |
| Ad2 ($mm^{-2}$) | | 0.0076 | 0.0100 |
| Difference between Ad1 and Ad2 ($mm^{-2}$) | | 0.0013 | 0.0084 |
| Graph of volume for minute region (PH rotation) | | FIG. 12 | FIG. 18 |
| Graph of volume for minute region (POP rotation) | | FIG. 13 | FIG. 19 |
| Ad3 | | 0.0058 | 0.0014 |
| Ad4 | | 0.0072 | 0.0087 |
| Difference between Ad3 and Ad4 | | 0.0014 | 0.0073 |
| Carry (Yard) | PH rotation | 204.4 | 204.0 |
| | POP rotation | 202.4 | 198.8 |
| | Difference | 2.0 | 5.2 |
| Total (Yard) | PH rotation | 212.8 | 214.0 |
| | POP rotation | 212.1 | 204.3 |
| | Difference | 0.7 | 9.7 |

While Ad1 and Ad2 of Example are greater than Ad1 of Comparative Example, they are smaller than Ad2 of Comparative Example. While Ad3 and Ad4 of Example are greater than Ad3 of Comparative Example, they are smaller than Ad4 of Comparative Example. The difference between Ad1 and Ad2 of Example is smaller than that of Comparative Example. The difference between Ad3 and Ad4 of Example is smaller than that of Comparative Example. As shown in Table 9, the flight distance of the golf ball of Example is greater than that of the golf ball of the Comparative Example. It is inferred that this is because in the golf ball of Example, transition of turbulent flow continues smoothly. Further, in the golf ball of Example, the difference between the flight distance at PH rotation and the flight distance at POP rotation is small. It is inferred that this is because the difference between the dimple effect for PH rotation and the dimple effect for POP rotation is small. From the results of evaluation, advantages of the present invention are clear.

By the evaluation method according to the present invention, the aerodynamic characteristic of a golf ball can be evaluated with high accuracy. By the designing process according to the present invention, a golf ball having an excellent aerodynamic characteristic can be obtained. The golf ball according to the present invention has excellent aerodynamic symmetry and a long flight distance.

The dimple pattern described above is applicable to a one-piece golf ball, a multi-piece golf ball, and a thread-wound golf ball, in addition to a two-piece golf ball. The above description is merely for illustrative examples, and various modifications can be made without departing from the principles of the present invention.

What is claimed is:

1. A process for designing a golf ball comprising the steps of:

using a computer to provide a phantom surface of a golf ball;

determining positions and shapes of numerous dimples on the phantom surface of the golf ball;

placing the numerous dimples on the phantom surface of the golf ball;

calculating a first data constellation regarding a parameter dependent on a surface shape of the golf ball, based on a surface shape appearing at a predetermined point moment by moment during rotation of the golf ball about a first axis;

calculating a second data constellation regarding a parameter dependent on a surface shape of the golf ball, based on a surface shape appearing at a predetermined point moment by moment during rotation of the golf ball about a second axis, the second axis being different from the first axis;

determining an aerodynamic symmetry of the golf ball based on a difference between a value obtained from the first data constellation and a value obtained from the second data constellation; and changing the positions or the shapes of the dimples if the difference between the value obtained from the first data constellation and the value obtained from the second data constellation exceeds a predetermined value.

2. The process according to claim 1, wherein in the step of determining the aerodynamic symmetry of the golf ball, the aerodynamic characteristic of the golf ball is determined based on fluctuation ranges of the first and second data constellations.

3. The process according to claim 1, wherein in the step of calculating the first and second data constellations, the first and second data constellations are calculated throughout one rotation of the golf ball.

4. The process according to claim 1, wherein in the step of calculating the first and second data constellations, the first and second data constellations are calculated based on a shape of a surface near a great circle orthogonal to a corresponding axis of the rotation.

5. The process according to claim 1, wherein in the step of calculating the first and second data constellations, the first and second data constellations are calculated based on a parameter dependent on a distance between a corresponding axis of the rotation and the surface of the golf ball.

6. The process according to claim 1, wherein in the step of calculating the first and second data constellations, the first and second data constellations are calculated based on a parameter dependent on a volume of space between a surface of a phantom sphere and the surface of the golf ball.

* * * * *